US007685851B2

(12) United States Patent
Lai

(10) Patent No.: US 7,685,851 B2
(45) Date of Patent: Mar. 30, 2010

(54) SECURITY PADLOCK HAVING A SECONDARY LOCKING SYSTEM

(75) Inventor: Karl Lai, Tai Po (HK)

(73) Assignee: The Sun Lock Company Ltd., Hong Kong (HK)

( * ) Notice: Subject to any disclaimer, the term of this patent is extended or adjusted under 35 U.S.C. 154(b) by 0 days.

(21) Appl. No.: 12/079,196

(22) Filed: Mar. 25, 2008

(65) Prior Publication Data

US 2008/0250825 A1 Oct. 16, 2008

Related U.S. Application Data

(60) Provisional application No. 60/923,460, filed on Apr. 13, 2007.

(51) Int. Cl.
*E05B 37/02* (2006.01)

(52) U.S. Cl. ..... 70/25; 70/30; 70/DIG. 9

(58) Field of Classification Search ..... 70/DIG. 9, 70/21, 25, 26, 30, 49, 38 A, 51–53, 284, 285
See application file for complete search history.

(56) References Cited

U.S. PATENT DOCUMENTS

| | | | | | |
|---|---|---|---|---|---|
| 539,650 | A * | 5/1895 | Searle | 70/16 |
| 695,458 | A * | 3/1902 | Hulzer et al | 70/15 |
| 1,240,146 | A * | 9/1917 | Jackson | 70/30 |
| 1,355,387 | A * | 10/1920 | Cohen | 70/29 |
| 4,070,879 | A * | 1/1978 | Thompson | 70/20 |
| 4,476,698 | A * | 10/1984 | Treslo | 70/25 |
| 6,029,481 | A * | 2/2000 | Lai | 70/25 |
| 6,408,660 | B1 * | 6/2002 | Lai | 70/30 |
| 6,843,080 | B1 * | 1/2005 | Yu | 70/21 |
| 6,848,283 | B1 * | 2/2005 | Lin | 70/21 |
| 7,047,772 | B2 * | 5/2006 | Yu | 70/21 |
| 7,140,209 | B2 * | 11/2006 | Lai | 70/25 |
| 7,225,648 | B2 * | 6/2007 | Lai et al. | 70/21 |
| 7,251,965 | B2 * | 8/2007 | Yu | 70/21 |
| 7,269,985 | B2 * | 9/2007 | Lai et al. | 70/446 |
| 2008/0066500 | A1 * | 3/2008 | Su | 70/21 |
| 2008/0209956 | A1 * | 9/2008 | Araujo | 70/21 |
| 2008/0209957 | A1 * | 9/2008 | Araujo | 70/21 |

* cited by examiner

*Primary Examiner*—Lloyd A Gail
(74) *Attorney, Agent, or Firm*—Melvin I. Stoltz

(57) ABSTRACT

By providing a padlock having a primary shackle and a secondary shackle which is easily employed whenever the primary shackle has been cut, an effective, easily produced, key operated or combination controlled padlock is achieved which enables the padlock to be quickly and easily opened for inspection by security personnel, while also enabling the padlock to be quickly relocked after inspection using a secondary locking shackle. In addition, the secondary locking shackle provides the user with notice that the padlock and suitcase had been opened by security personnel. In accordance with the present invention, the padlock incorporates a housing and a primary shackle which is constructed for being lockingly engaged with the housing, as well as dis-engaged from the housing whenever the padlock is opened.

5 Claims, 40 Drawing Sheets

SECURITY PADLOCK HAVING A SECONDARY LOCKING SYSTEM

RELATED APPLICATIONS

This application is related to U.S. Provisional Patent Application Ser. No. 60/923,460, filed Apr. 13, 2007 entitled SECURITY PADLOCK HAVING A SECONDARY LOCKING SYSTEM.

TECHNICAL FIELD

This invention relates to padlocks and lock systems and, more particularly, to padlocks constructed for being easily opened by security personnel and re-locked.

BACKGROUND ART

Numerous padlock constructions have been developed and are widely employed by individuals to prevent unauthorized persons from gaining access to any particular item or area which has been closed and locked. In this regard, many lock constructions are designed to be opened by a key, while numerous combination lock constructions have also been developed which are open by knowledge of a particular combination.

One particular type of combination lock that has become very popular due to its convenience of use is a combination lock which employs a plurality of rotatable independent dials, each of which forms one of the indicia, usually numerals or letters, which comprise a combination for releasing the lock. Typically, the combination lock has one mode or position in which the user is able to set or reset the desired combination sequence. However, in spite of the popularity of these combination locks, key-operated locks remain the most popular and most prevalent.

In spite of the substantial effort which has been expended in developing key control padlocks, prior art constructions continue to suffer from the use of components which are difficult and expensive to manufacture. In particular, one of the principal components of key controlled padlocks is the rotatable cylinder plug which is rotationally mounted in a cylinder housing and is constructed for being responsive to a particularly key for enabling the cylinder plug to rotate about its central axis.

Although the cylinder plug is a principal element and is required in each key controlled padlock construction, cylinder plugs are expensive to manufacture since they must be individually cut from round metal rods and then individually machined to obtain the desired construction. As a result, substantial effort and expense is required. Furthermore, although this problem has existed in the art for numerous years, no effective resolution of this difficulty has been realized.

Another common problem which has consistently plagued prior art constructions is the assembly and production costs associated with key controlled padlocks. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal components of the lock, thereby causing damage to these components or interfering with the ease of operation of the lock. Although numerous attempts have been made to reduce the adverse effects caused by contaminants reaching these components, such attempts have been incapable of completely eliminating this problem.

A further difficulty which has recently arisen and has caused consumers to become increasingly concerned is the requirement that all secured locks may be broken by customs officers and/or inspection or security personnel in order to gain access to luggage which is deemed suspicious. Under security regulations that have recently been implemented, all luggage must be scanned or inspected to prevent the transportation of potentially dangerous items or products which are deemed to be undesirable. In those instances when the luggage is scanned and further visual inspection is required, the inspectors have the authority to open the luggage for visual inspection, including physically breaking any lock which may be on the luggage and cannot be opened by the customs officers.

Consequently with these new regulations presently being implemented, all prior art lock systems which are incapable of being opened by inspectors and/or security personnel are subject to being physically broken, in order to gain access to any luggage which needs to be visually inspected. As a result, consumers will be faced with the possibility that any lock system employed to protect the contents of the suitcase can be physically removed by security personnel, leaving the luggage completely unprotected during the remainder of the trip.

Furthermore, even in those instances when security personnel are able to open a padlock in order to visually inspect the contents of the suitcase, the consumer is unable to know with certainty whether or not a particular locked suitcase had been visually inspected by the security personnel. Without any positive indication regarding the security personnel's activity with a particular piece of luggage, the consumer is unable to know whether any missing or damaged item in the suitcase may have resulted during a security inspection.

In addition, it has recently been discovered that some individuals have manufactured unauthorized copies of the keys employed by security personnel and have allowed these duplicate key copies to be distributed to un-authorized personnel. As a result, these unauthorized individuals are able to gain access to locked suitcases and remove any content found therein which may be of value. As a result, owners of the suitcases have found valuables missing from their suitcases, even though the suitcase appears to have been properly locked.

Therefore, it is a principal object of the present invention to provide a padlock which can be opened by the owner either employing a secret combination or a special key while also incorporating a dual shackle construction which enables security personnel to break the shackles for inspection of the suitcase, when required, while also providing a secondary shackle component for enabling the security personnel to securely relock the suitcase after inspection.

Another object of the present invention is to provide a padlock having the characteristic features described above which is constructed for being broken by security personnel, if needed, while also being quickly and easily completely locked by the security personnel using a secondary shackle locking member.

Another object of the present invention to provide a padlock having the characteristic features described above which can be opened by employing either a user key or a master key and incorporates an automatically initiated positive indicator or signal for informing the consumer whenever the padlock has been opened using the master key.

Another object of the present invention is to provide a padlock having the characteristic features described above which is easily produced and provides the user with complete control over re-setting of the indicator.

Another object of the present invention is to provide a padlock having the characteristic features described above which automatically locks the indicator/signal in its raised position once the indicator/signal has been activated.

Another object of the present invention is to provide a padlock having the characteristic features described above which also provides an indicator or signal which is highly visible and easily seen by the user.

A further object of the present invention is to provide a padlock having the characteristic features described above which requires a separate key for resetting the indicator or signal for enabling only the user to reset the indicator or signal when the lock has been opened.

Other and more specific objects will in part be obvious and will in part appear hereinafter.

SUMMARY OF THE INVENTION

By employing the present invention, all of the difficulties and drawbacks found in prior art constructions are virtually eliminated and an effective, easily produced, key operated or combination controlled padlock is achieved which enables the padlock to be quickly and easily opened for inspection by security personnel, while also enabling the padlock to be quickly re-locked after inspection using a secondary locking shackle. In addition, the secondary locking shackle provides the user with notice that the padlock and suitcase had been opened by security personnel.

In accordance with the present invention, the padlock incorporates a housing and a generally J-shaped shackle which is constructed for being lockingly engaged with the housing, as well as dis-engaged from the housing whenever the padlock is opened. In addition, the housing incorporates locking means cooperatively and controllably associated with the shackle for enabling the shackle to be alternately moved between its locked position and its unlocked position.

The locking means employed in the housing typically comprises either a combination controlled locking system or a key controlled locking system. Regardless of which system is employed, the shackle construction used in the padlock is virtually identical, for enabling the shackle to be broken by security personnel and then re-locked using the secondary shackle member.

Although a wide variety of alternate combination controlled locking systems can be employed in the padlock of the present invention, the preferred embodiment of the present invention incorporates a combination controlled locking system as generally disclosed and described in U.S. Pat. No. 6,029,481, the pertinent portions of which are incorporated herein by reference. Similarly, a wide variety of alternate key controlled locking constructions can be employed for providing a key controlled locking section, if so desired. One example of a preferred key controlled locking section can be found in U.S. Pat. No. 7,140,209, the pertinent portions of which are incorporated herein by reference.

Regardless of the specific construction employed for the key controlled locking section or the combination controlled locking section in the padlock of the present invention, a principal construction must incorporate a movable latch which is engagable with a receiving zone formed in the J-shaped shackle. By securely maintaining the latch engaged in the receiving zone, the shackle is securely affixed to the housing. However, whenever the latch is released by properly operating either the key controlled locking section or the combination controlled locking section, the latch is easily disengaged from the receiving zone of the J-shaped shackle, enabling the J-shaped shackle to be released from the housing.

In the typical use of the padlock of the present invention, the user securely affixes the padlock to a suitcase, package, or other item to be locked, by releasing the shackle from locked engagement with the housing, and once the free end of the shackle has been engaged with the appropriate holding means of the suitcase, the shackle is lockingly engaged in the housing of the padlock. Once the shackle is lockingly engaged with the housing of the padlock, the desired suitcase, package, or other item is securely locked.

In accordance with the present invention, the J-shaped shackle incorporates a portion thereof which comprises a reduced diameter, as compared to the diameter of the remainder of the shackle. In addition, in the preferred embodiment, the reduced diameter portion of the shackle is formed directly adjacent an axially movable collar or sleeve which is constructed for cooperating with the reduced diameter portion, particularly after the reduced diameter portion has been severed by the security officer.

In accordance with the present invention, the need for security personnel to employ specialized keys is totally eliminated, thereby eliminating the possibility that copies of the security keys can be created and given to unauthorized individuals. Instead, the present invention provides a portion or zone integrally formed along the length of the shackle which incorporates a reduced diameter or narrow area for enabling security personnel to easily cut the reduced diameter/narrowed area of the shackle for effectively severing the shackle along its length. Once the shackle has been severed or broken, the severed/broken portion can be easily removed from the padlock in its entirety.

In order to prevent any damage to the suitcase or operating personnel, the axially movable collar or sleeve is moved from a first, stowed position to a second, raised position, peripherally surrounding and protecting the portion of the shackle which has been broken. In this way, any jagged edges formed by the cutting or severing of the reduced diameter shackle zone/area are quickly and easily peripherally surrounded and protected from contact with people or the suitcase itself. As a result, damage or injury is prevented.

Once the security personnel has opened the suitcase for the required inspection after breaking the shackle in the reduced diameter zone, the padlock of the present invention enables the security officer to quickly and easily re-lock or resecure the padlock to the suitcase. In this regard, the security personnel merely removes a secondary shackle member stored in the padlock from its stored position to its fully extended position, while also advancing the free end of the secondary shackle through the locking members of the suitcase. Then, the free end is inserted into the housing of the padlock where the principal shackle had been retained, allowing the end of the secondary shackle to be securely engaged with the latching means of the padlock. Once the latching means is engaged in the receiving zone of the secondary shackle, the padlock is fully and completely locked in engagement with the suitcase, as the user would desire.

As is evident from the foregoing detailed discussion, the padlock of the present invention completely eliminates the need for security personnel to possess a plurality of different keys for opening various security locks. Instead, whenever a suitcase or package requires further inspection, the security personnel merely breaks the shackle of the padlock and then inspects the suitcase as required.

Once completed, a secondary shackle stored in the padlock is withdrawn from the stored position and reinserted into the receiving portion of the padlock for enabling the padlock to be secured to the suitcase or package after the inspection has been completed. In this way, the prior art difficulties and drawbacks are eliminated, and the user is assured that the suitcase or package is completely locked after any necessary inspection.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 1:
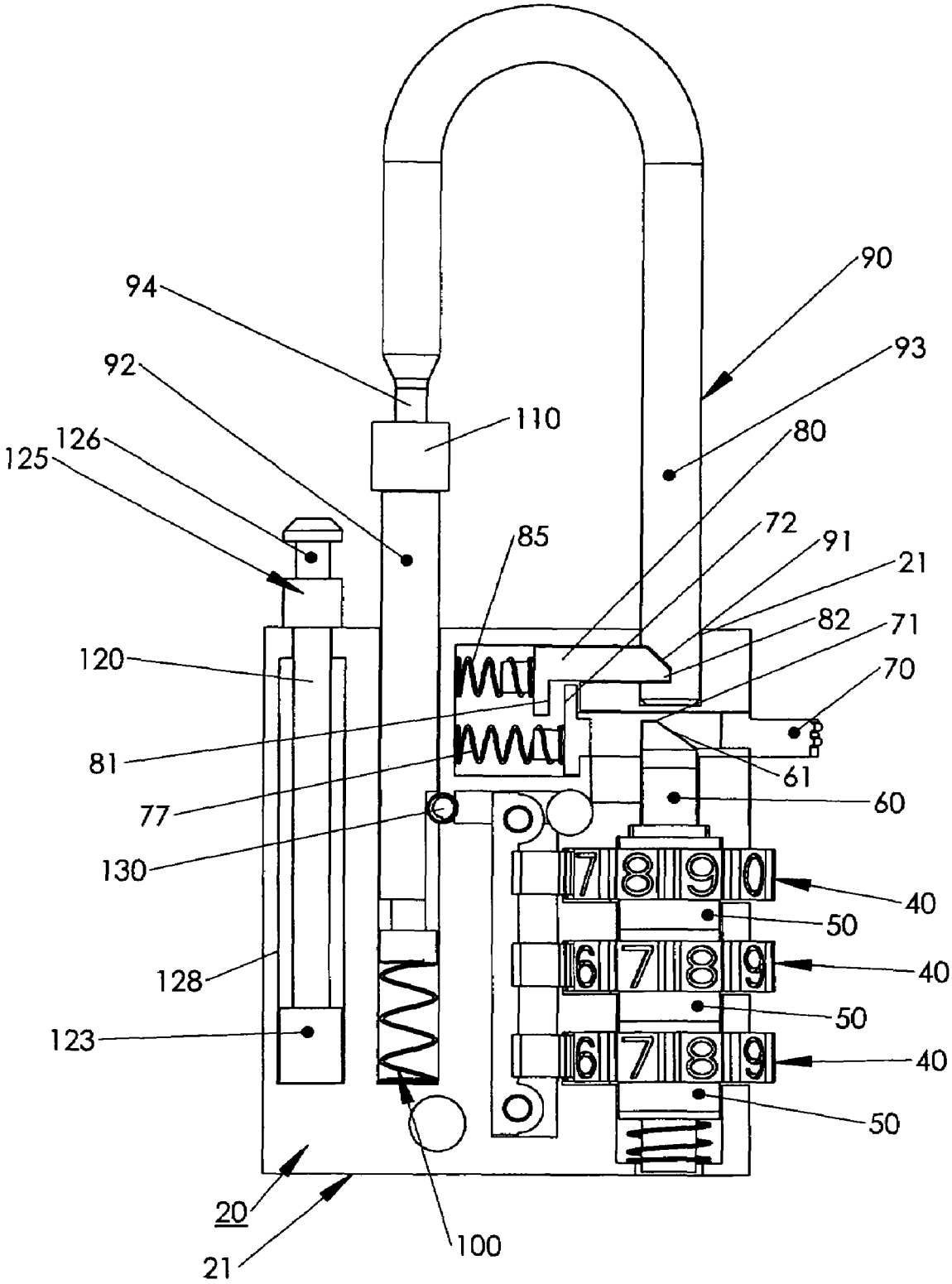
FIG. 1 is a front elevation view of the padlock of the present invention, shown in the closed and locked position with the cover portion of the housing removed, and incorporating a combination controlled locking section.
Figure 2:
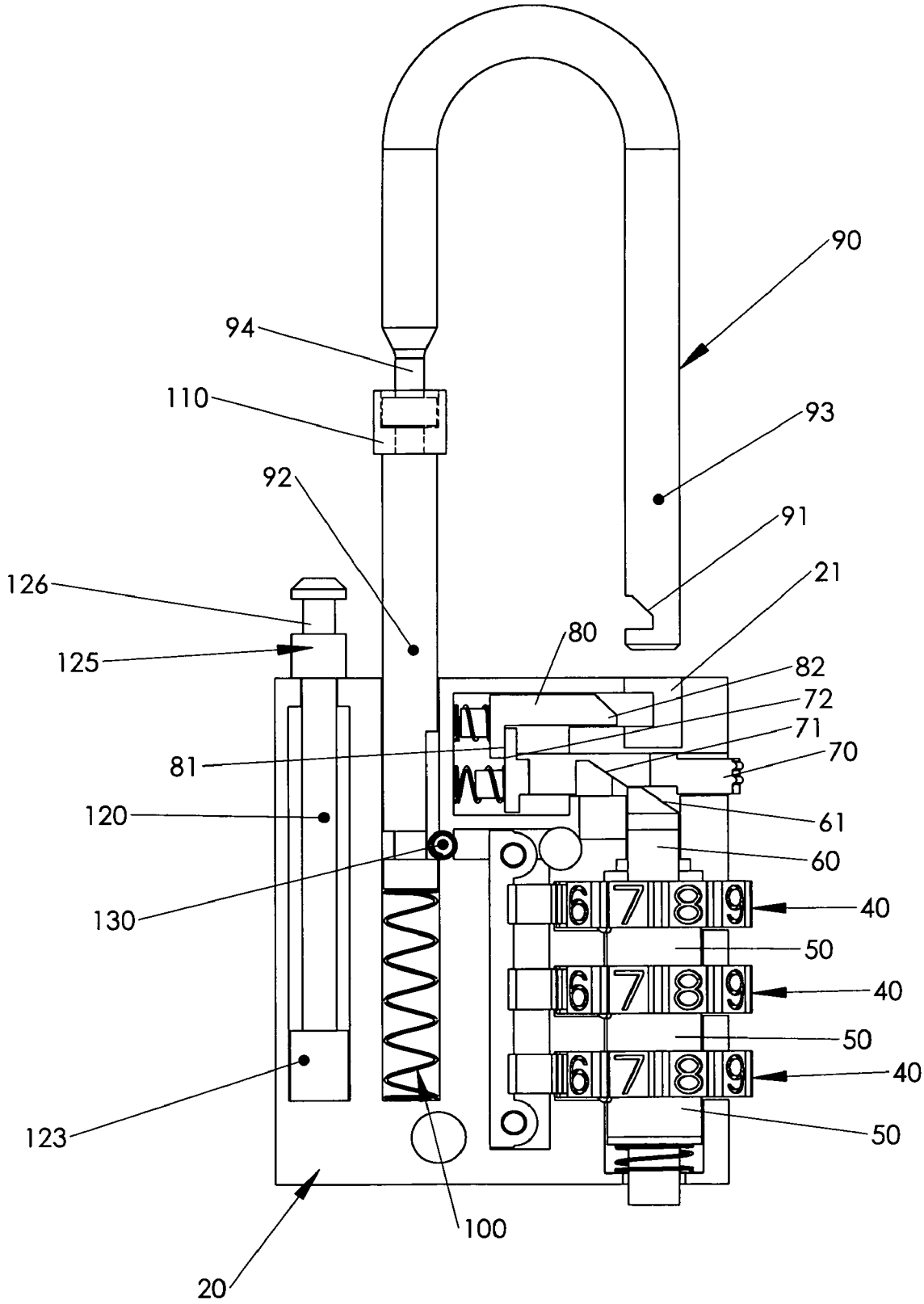
FIG. 2 is a front elevation view of the padlock of FIG. 1 shown in the unlocked, open position.
Figure 3:
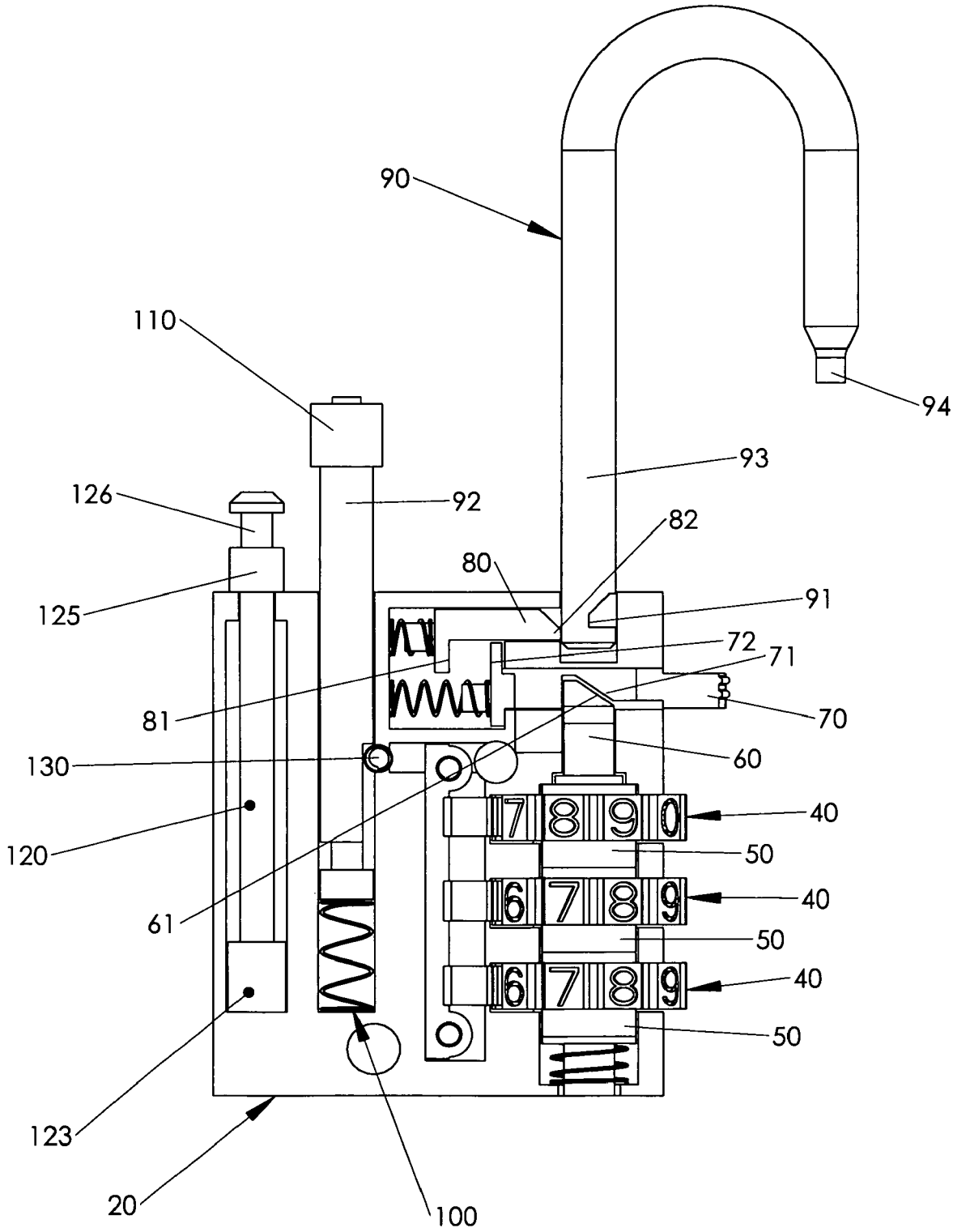
FIG. 3 is a front elevation view of the padlock of FIG. 1 shown after inspection with the shackle having been severed.
Figure 4:
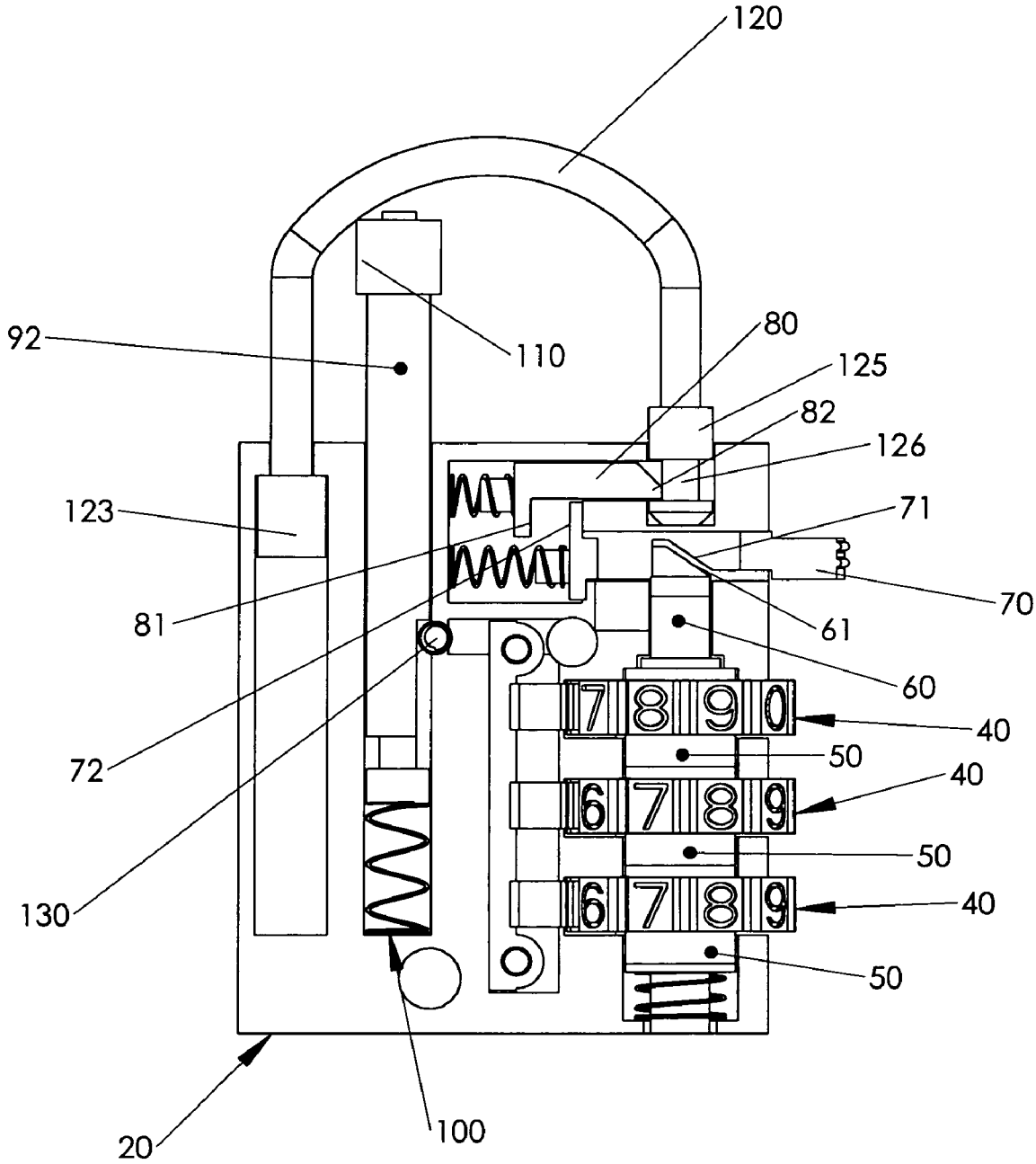
FIG. 4 is a front elevation view of the padlock of FIG. 1 shown with the secondary shackle member installed and locked.
Figure 5A:
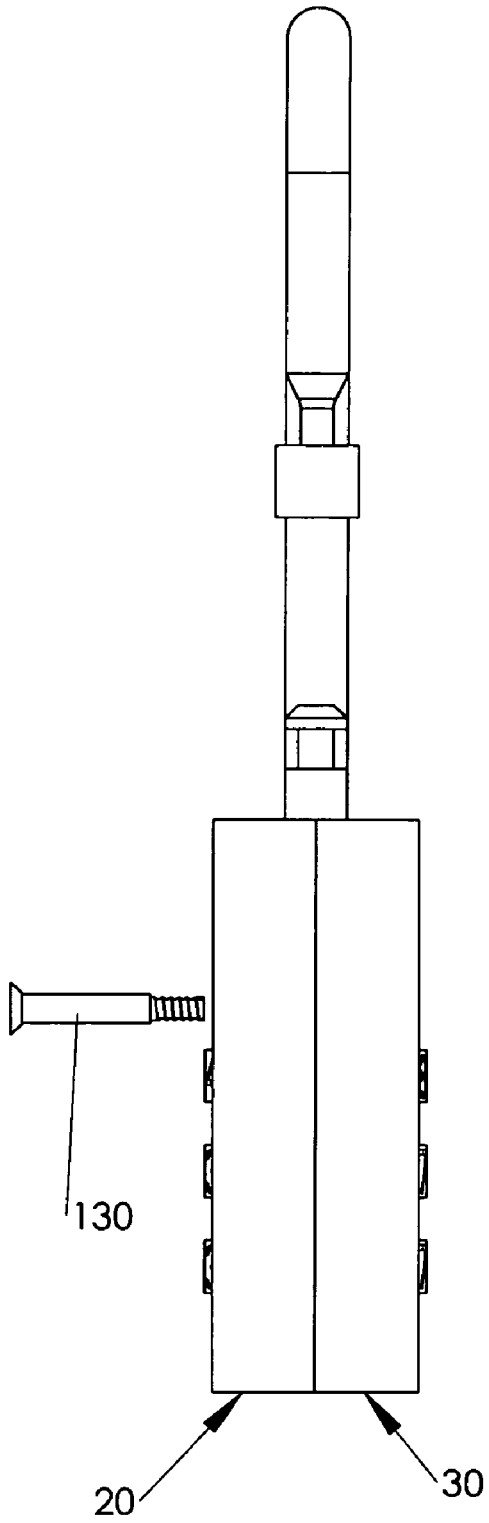
FIG. 5A is a side view of the padlock of FIG. 1 in the process of having the principle shackle member replaced.
Figure 5B:
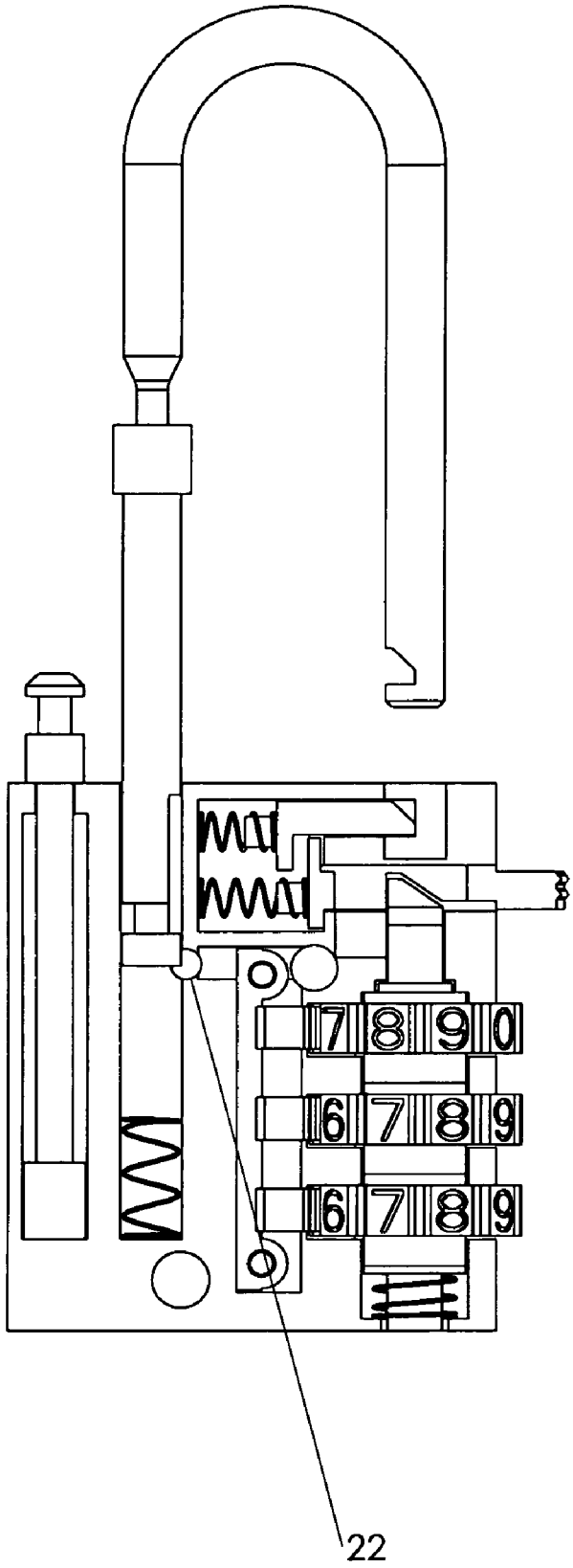
FIG. 5B is a front elevation view of the padlock of FIG. 5A.
Figure 6B:
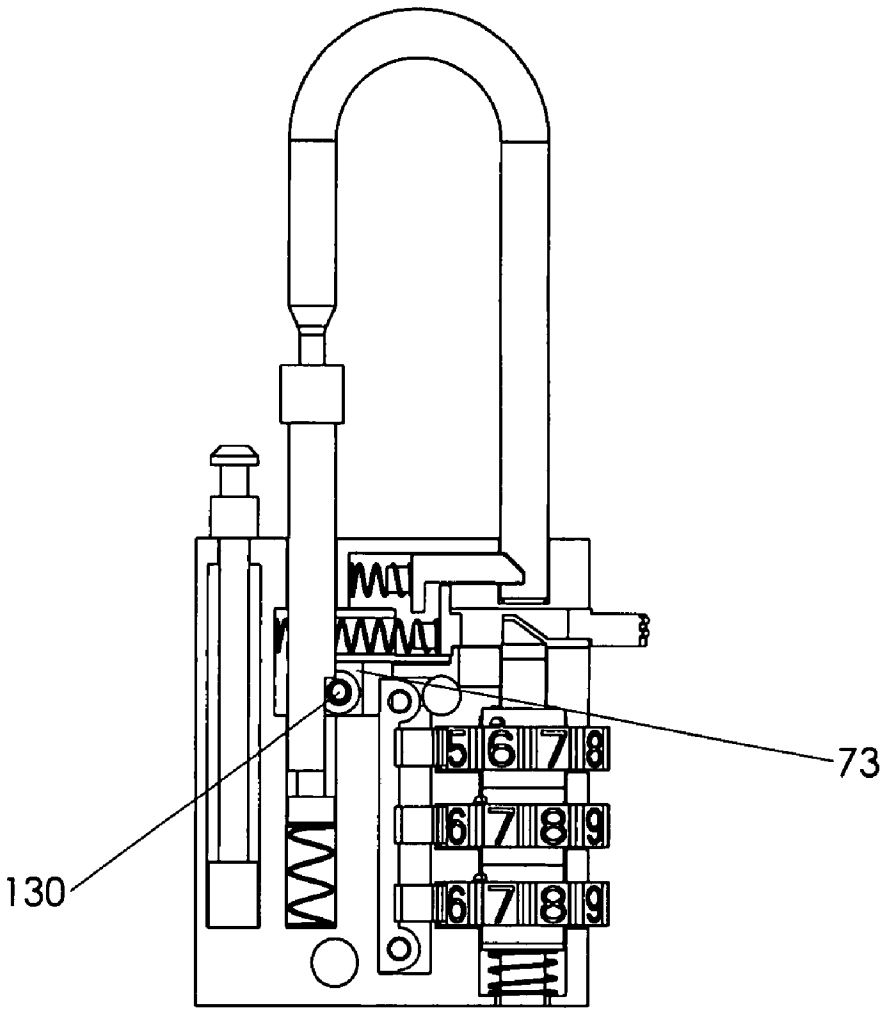
FIG. 6B is a front elevation view of the padlock of FIG. 5A with the cover removed.
Figure 6A:
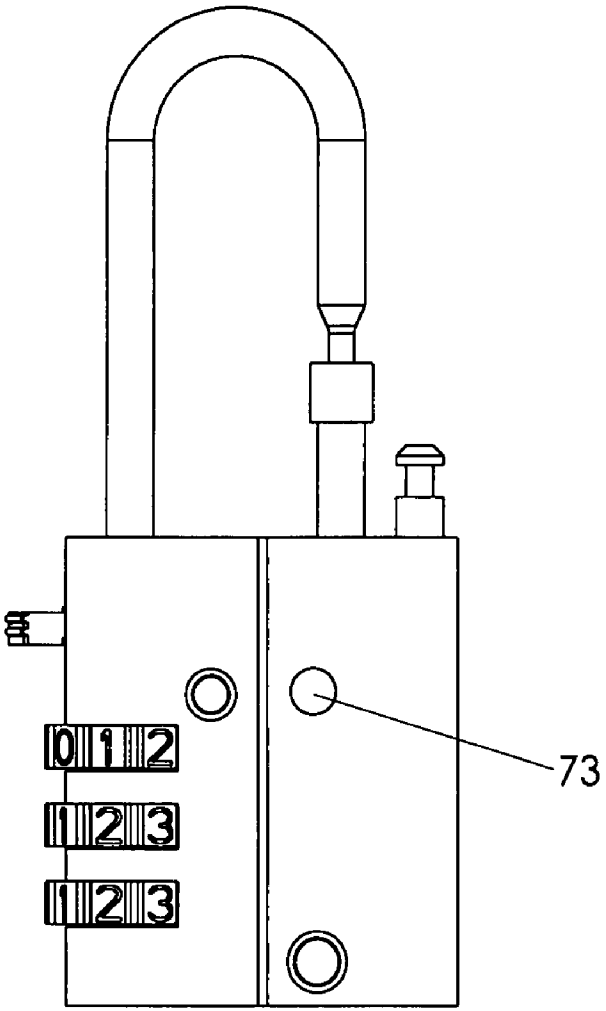
FIG. 6A is a rear elevation view of the padlock of FIG. 5A.
Figure 7B:
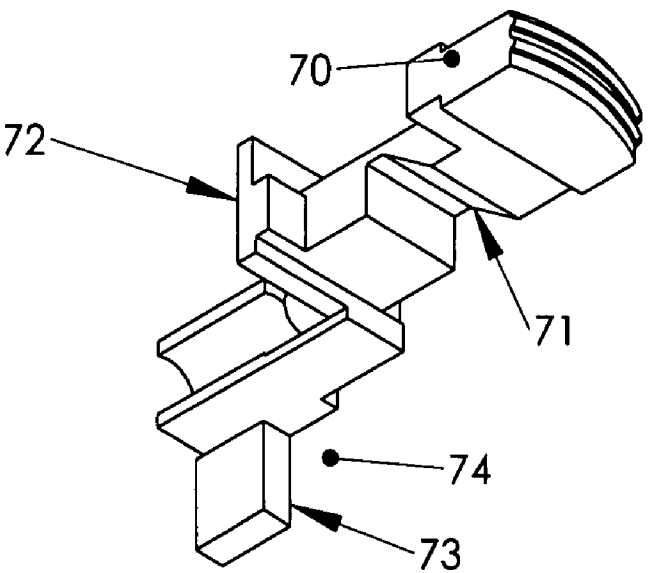
FIG. 7B is a perspective view of the pushbutton of FIG. 7A.
Figure 7A:
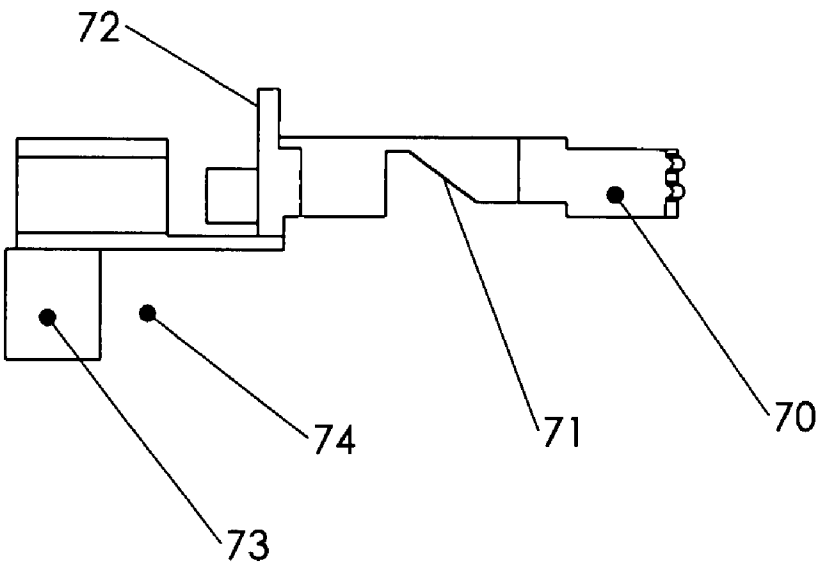
FIG. 7A is a side elevation view of the pushbutton portion forming a component of the padlock of FIG. 1.
Figure 9:
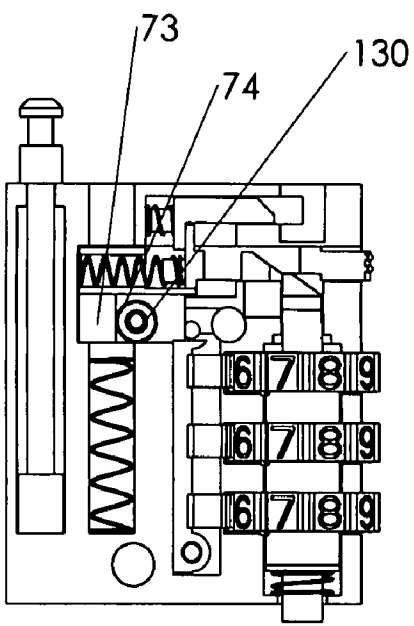
FIG. 9 is a front elevation view of the padlock of FIG. 8A with the principle shackle removed.
Figure 8B:
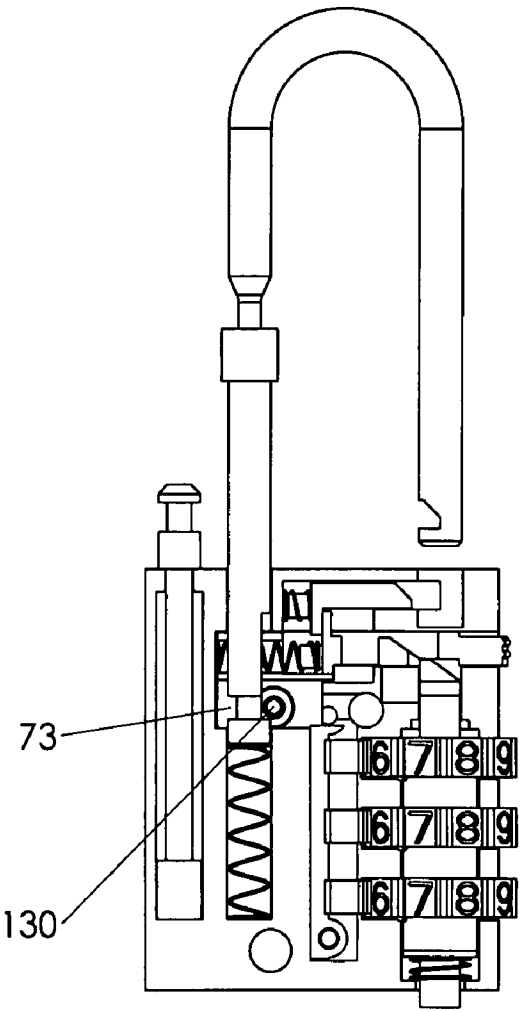
FIG. 8B is a front elevation view of the padlock of FIG. 8A with the cover portion removed.
Figure 8A:
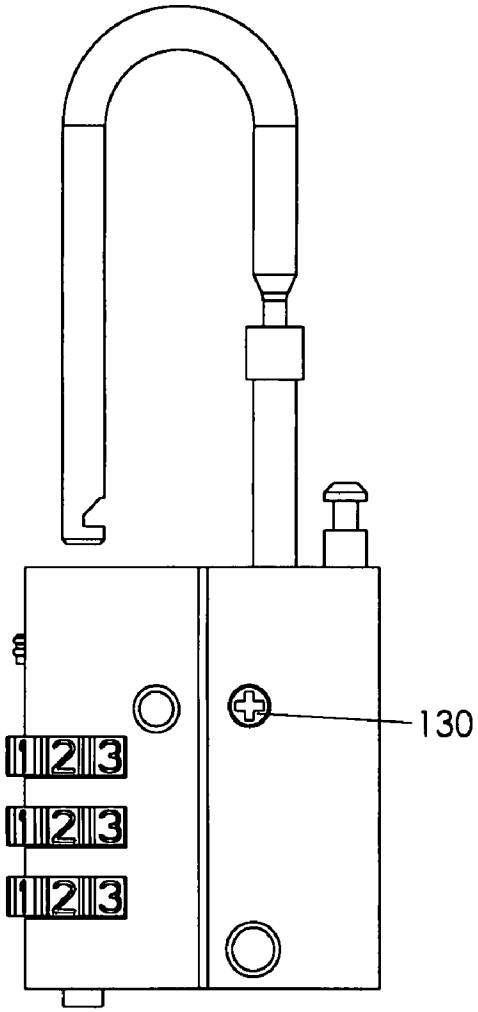
FIG. 8A is a rear elevation view of an alternate embodiment of the padlock of FIG. 1.
Figure 10:
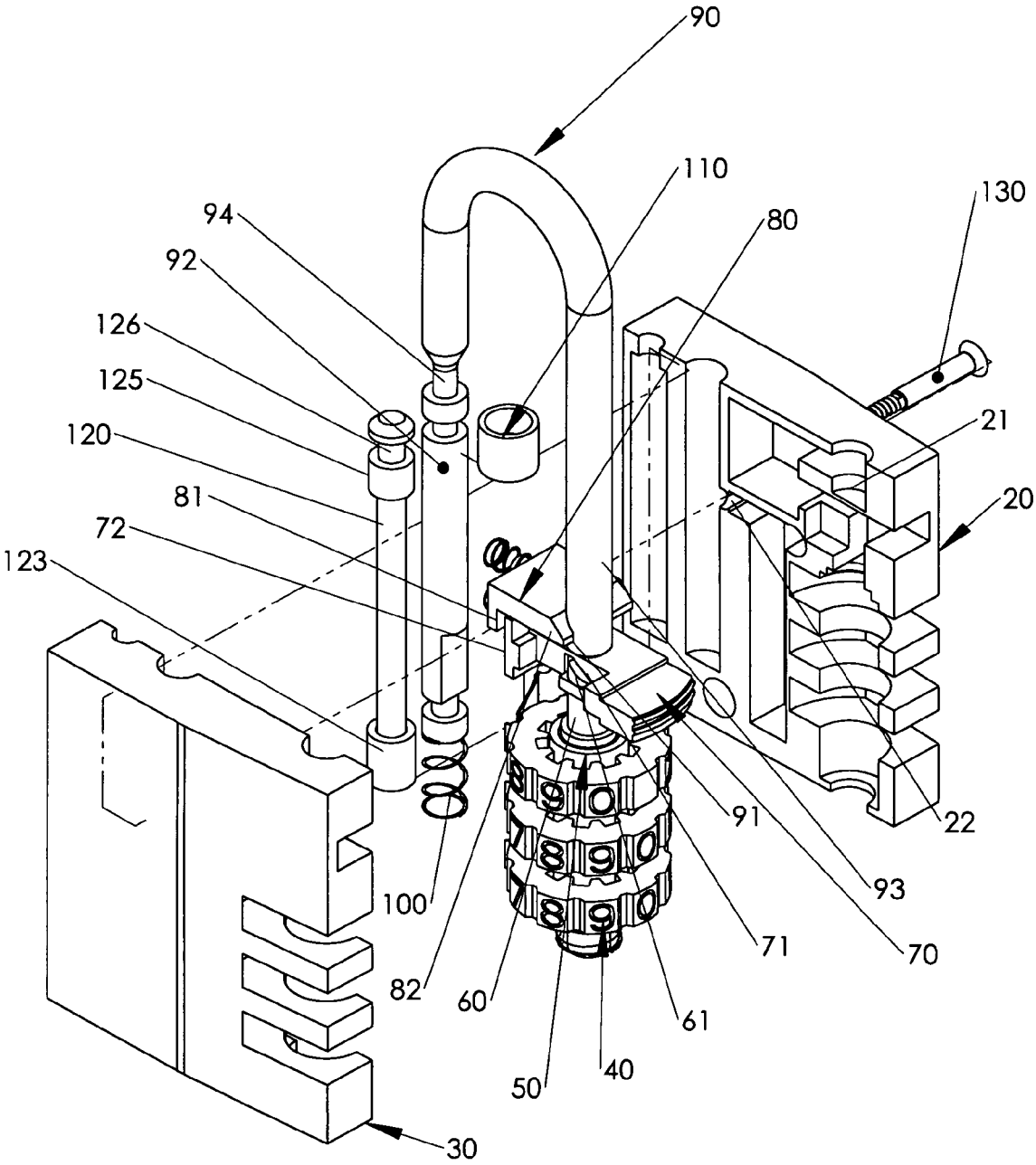
FIG. 10 is an exploded perspective view of the padlock of FIG. 1.
Figure 11:
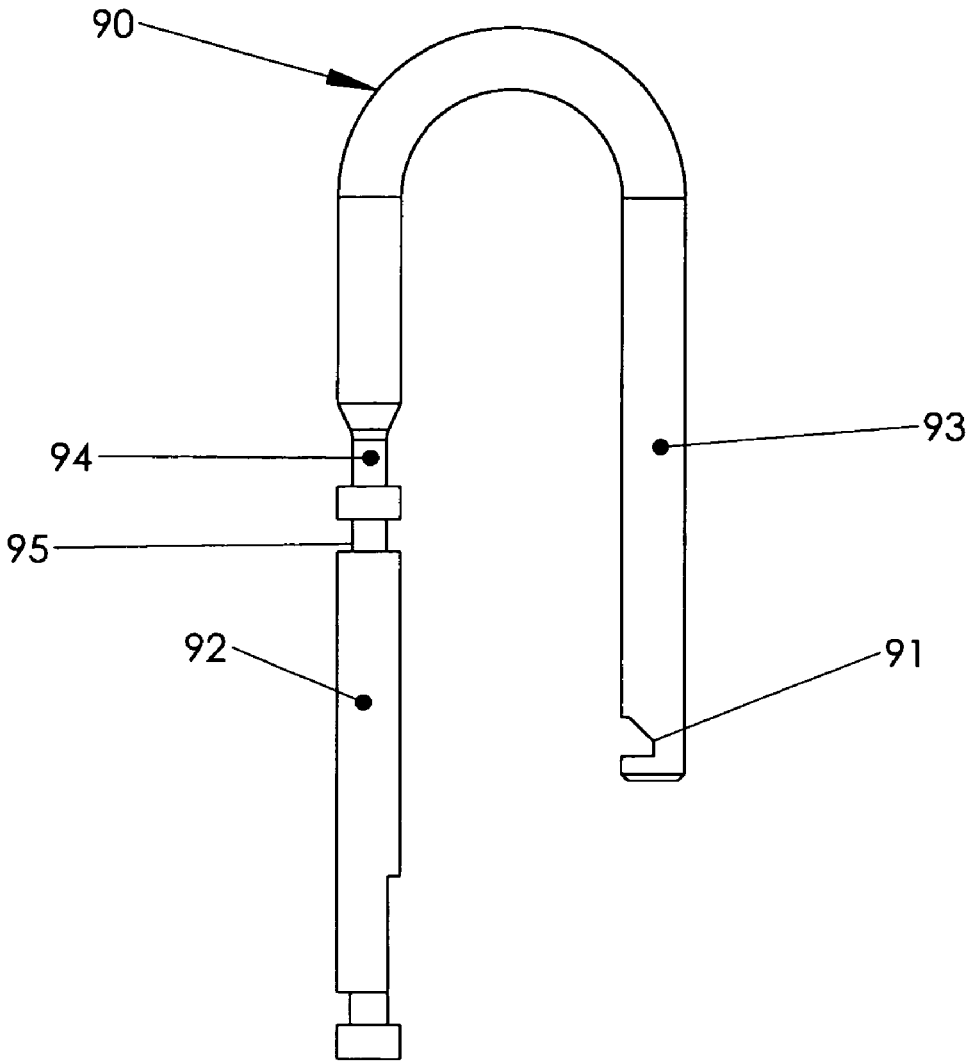
FIG. 11 is a front elevation view of the principle shackle portion of the padlock of FIG. 1.
Figure 12:
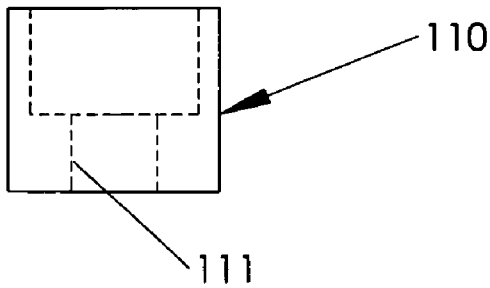
FIG. 12 is a side elevation view of the axial movable ring forming a portion of the padlock of FIG. 1.
Figure 13:
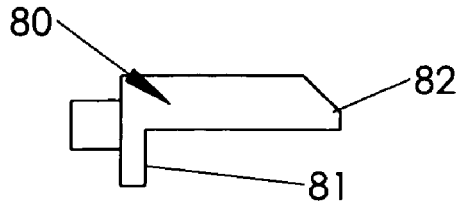
FIG. 13 is a side elevation view of the latch portion of the padlock of FIG. 1.
Figure 14:
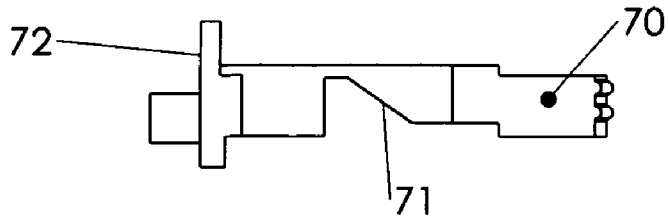
FIG. 14 is a side elevation-view of the pushbutton portion of the padlock of FIG. 1.
Figure 15:
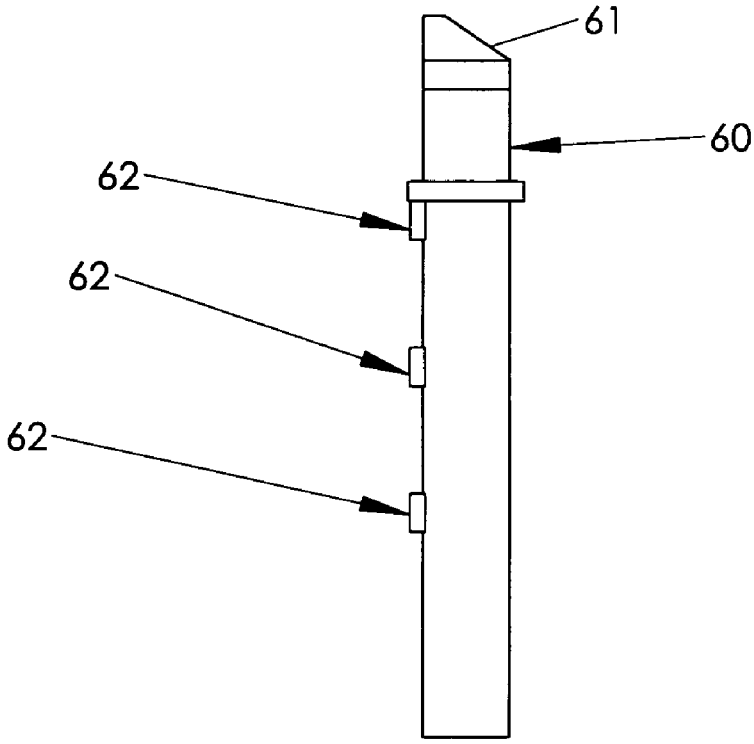
FIG. 15 is a side elevation view of the axial movable sleeve member of the padlock of FIG. 1.
Figure 16:
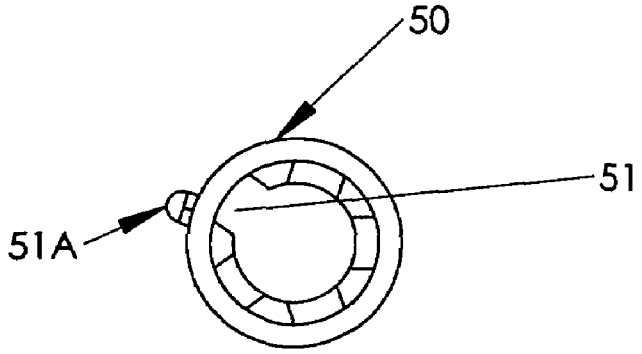
FIG. 16 is a top plan view of the clutch ring member of the padlock of FIG. 1.
Figure 17:
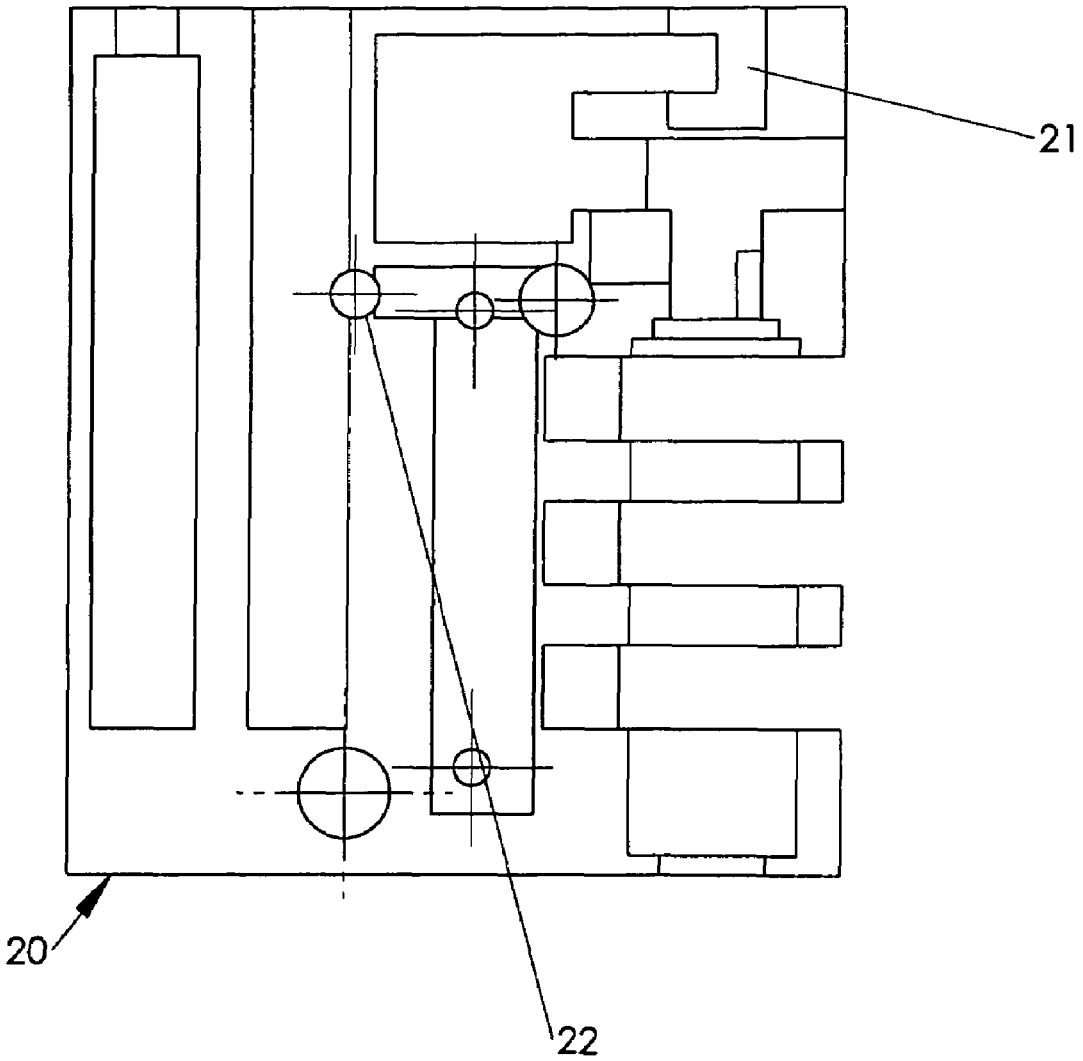
FIG. 17 is a front elevation view of the rear housing portion of the padlock of FIG. 1.
Figure 19:
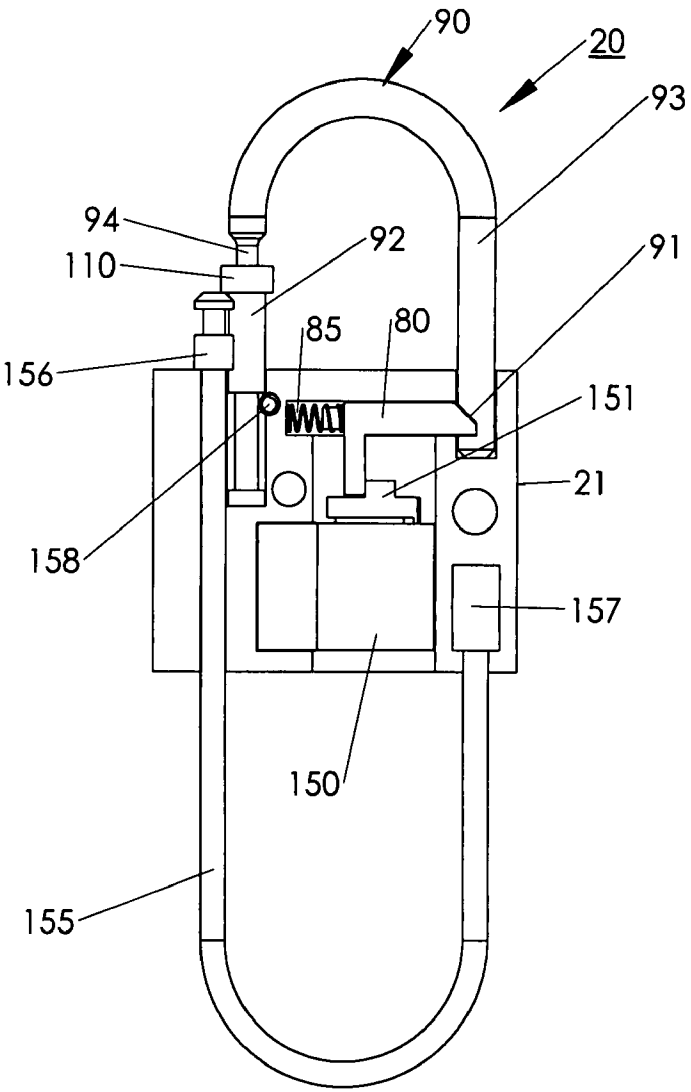
FIG. 19 is a front elevation view of the padlock of FIG. 18 with the cover portion removed with the padlock in the locked position.
Figure 18:
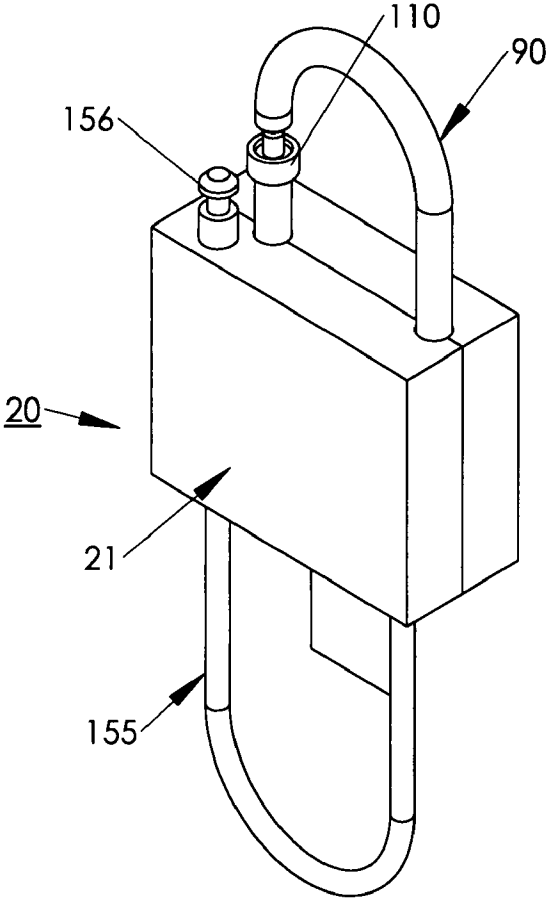
FIG. 18 is a perspective view of an alternate embodiment of the padlock of the present invention incorporating a key controlled locking section.
Figure 56:
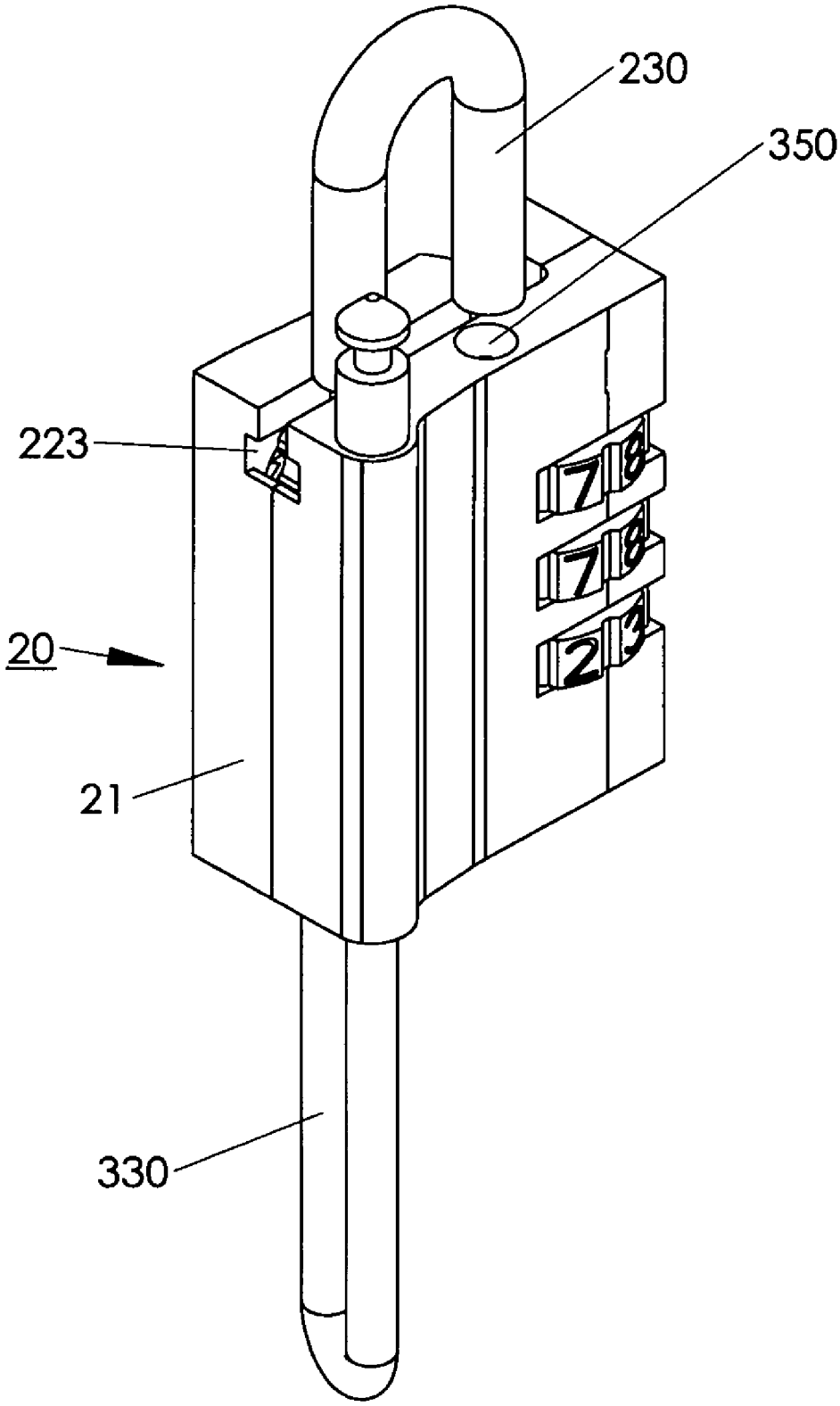
FIG. 56 is a perspective view of another still further alternate embodiment of the padlock of the present invention shown in the closed and locked position and incorporating a combination control locking section.

By referring to FIGS. 1-56, along with the following detailed discussion, the construction and operation of several alternate embodiments of padlock 20 of the present invention can best be understood. It is to be noted, however, that the preferred alternate embodiments of the present invention are depicted in FIGS. 1-56, and detailed below. However, variations, further alternate constructions, and further configurations of the padlock of the present invention can be made without departing from the scope of this invention. Consequently, it is to be understood that this disclosure is provided for exemplary purposes only and should not be considered as a limitation of the present invention.

In FIGS. 1-17 one preferred construction of padlock 20 of the present invention is fully depicted incorporating a combination controlled locking section. In addition to showing various alternate views of the fully assembled padlock 20 of the present invention, these figures also provide detailed views of various components employed in constructing this embodiment of padlock 20. As a result, a review and analysis of FIGS. 1-17 provides a full and complete disclosure of this preferred construction of this embodiment of the present invention, while FIGS. 18-56 depict alternate preferred embodiments.

As shown, padlock 20 preferably comprises housing 21 which is cooperatively associated with J-shaped shackle 90 which is constructed for movement between locked engagement with housing 21 and being unlocked therefrom. In the preferred embodiment, J-shaped shackle 90 incorporates long leg 92 and short leg 93. Furthermore, long leg 92 is mounted in locked engagement with housing 21, while being axially movable relative thereto whenever short leg 93 is disengaged from housing 21.

In order to provide the locking and unlocking disengagement of shackle 90 with housing 21, short leg 93 of shackle 90 passes through an aperture formed in housing 21 and incorporates a notch 91 formed near the terminating end thereof. Notch 91 is cooperatively associated with latch 80 constructed for being moved into and out of locking engagement with notch 91 of short leg 93 of shackle 90. In addition, as is more fully detailed below, padlock 20 also incorporates secondary shackle or cable 120 which is mounted in housing 21 and is constructed for axial movement relative to housing 21 while being anchored at one end thereof within housing 21.

In the preferred embodiment, padlock 20 comprises a combination controlled locking section which controls the movement of push button 70. In this regard, longitudinally extending shaft or spindle 60 is peripherally surrounded by a plurality of dials 40 which control the axial or longitudinal movement of spindle 60. Dials 40 are cooperatively associated with clutch wheels 50 which incorporate notches 51, and are constructed for enabling spindle 60 to move longitudinally when notches 51 are properly aligned.

In addition, spindle 60 incorporates sloping surface 61 which is cooperatively associated with sloping cam surface 71 formed along push button 70. Furthermore, push button 70 is biased by spring member 77 to be continuously forced into a position outwardly extending from housing 21. In addition, as is more fully detailed below, whenever spindle 60 is prevented from axial movement, push button 70 is incapable of being forced into housing 21 against the biasing forces of spring member 77, due to the contact between sloping surface 61 of spindle 60 and the cooperating cam surface 71 of push button 70.

In the preferred construction, push button 70 incorporates a wall member 72 extending upwardly from push button 70 and positioned for cooperating with flange 81 of latch 80. As depicted, latch 80 is mounted in housing 21 and is biased by spring member 85 into locked engagement with notch 91 of shackle 90. By employing this construction, padlock 20 of the present invention is capable of operating in a generally conventional manner, for being mounted to any desired suitcase, product, or the like by employing shackle 90 and securely locking short leg 93 of shackle 90 in housing 21, by the locking interengagement of latch 80 with notch 91 of shackle 90.

In addition, whenever padlock 20 is to be removed from the suitcase, package, all other product to which it has been affixed, dials 40 are placed in the combination displaying orientation, thereby enabling spindle 60 to be axially movable relative thereto. Once this position has been achieved, push button 70 can be advanced into housing 21, causing spindle 60 to move downwardly, while simultaneously placing wall 72 into contact with flange 81 of latch 80, forcing latch 80 out of engagement in notch 91 of shackle 90. Once latch 80 has been removed from locked engagement with shackle 90, shackle 90 is able to automatically disengage from housing 21, due to the operation of the biasing spring 100 on long leg 92.

As discussed above, whenever dials 40 are placed with the desired, preset combination being properly displayed, spindle 60 is capable of axial movement relative thereto. However, whenever dials 40 are not positioned with the proper indicia displayed in the correct orientation, spindle 60 is incapable of longitudinal movement. As detailed above, the overall construction and operation of dials 40 and the entire combination controlled locking section of the present invention are disclosed in U.S. Pat. No. 6,029,481, the pertinent portions of which are incorporated herein by reference.

In accordance with the present invention, shackle 90 incorporates a reduced diameter neck portion 94 which is constructed for enabling security personnel to easily cut shackle 90 whenever required for inspecting the suitcase or other item to which padlock 20 has been secured. By incorporating reduced diameter neck portion 94 in long leg 92 of shackle 90, inspectors are able to quickly and easily sever shackle 90 for enabling padlock 20 to be easily removed from the suitcase or other package in order to allow the security personnel to gain access to the suitcase/package.

Once shackle 90 has been severed or cut in reduced diameter portion 94, short leg 93 of shackle 90 is able to be freely moved in a manner which will enable short leg 93 to be disengaged from housing 21. In this regard, latch 80 which is engaged in notch 91 of shackle 90 is mounted in housing 21 independent of any component other than biasing spring 85. As a result, the security officer is able to remove short leg 93 of shackle 90 from housing 21 by merely rotating short leg 93 through an arc of about 180°, which will effectively cause latch 80 to be longitudinally moved in housing 21, and become disengaged from notch 91. Once latch 80 is disengaged, short leg 93 can be removed from housing 21 and thrown away.

Furthermore, long leg 92 of shackle 90 will remain securely mounted in housing 21 after reduced diameter neck portion 94 has been severed. In order to protect the suitcase, package, as well as any individual from any injury or harm, axially movable collar 110 is mounted to long leg 92 of shackle 90 in direct association with reduced diameter neck portion 94. In this way, once reduced diameter neck portion 94 has been cut and short leg 93 has been removed, axially movable collar 110 can be raised to peripherally surround the area where neck portion 94 has been severed. In this way, collar 110 removes any jagged edges that may exist from contacting the suitcase or individuals, thereby preventing any damage or injury.

Once the security officer has completed his inspection of the suitcase, package, or other item, padlock 20 of the present invention is quickly and easily re-locked on the suitcase in order to protect the contents of the suitcase. In this regard, in order to enable padlock 20 to be re-locked by the security officer, padlock 20 incorporates secondary shackle 120 mounted in housing 21.

As clearly shown in the drawings, secondary shackle 120 incorporates free end 125 formed at one end of an elongated shaft, with enlarged head 123 mounted at the opposed end thereof. In addition, secondary shackle 120 is retained within elongated cavity 128 formed in housing 21 for being telescopically removed from housing 21 with enlarged head 123 being brought into abutting contact with cavity 128 when secondary shackle 120 has been fully withdrawn. In this way, enlarged head 123 remains locked in retaining cavity 128, while the remainder of secondary shackle 120 is fully removed therefrom.

When secondary shackle 120 has been removed from its stowed position in cavity 128 of housing 21, latching collar 126 of free end 125 is able to be inserted into the locking means of the suitcase and then advanced through the aperture formed in housing 21, enabling latching collar 126 to become engaged with latch 80 of padlock 20. Once latch 80 is fully engaged with collar 126 of secondary shackle 120, the suitcase, package, or other item is fully locked, for securing the contents thereof from unwanted theft.

Once the user receives the suitcase, the user immediately recognizes that the suitcase has been inspected due to the presence of the secondary shackle in locked engagement with housing 21. In addition, since the user-defined combination has not been altered, the user is able to quickly and easily remove padlock 20 from the suitcase, by merely placing dials 40 in the pre-determined combination. Once the dials have been properly oriented, secondary shackle 120 can be disengaged from housing 21 by merely pressing pushbutton 70.

In this preferred embodiment, the user is able to remove the severed long leg 92 of shackle 90 and reinsert a new shackle 90 in its place. In order to achieve this result, housing 21 is disassembled and a replacement shackle 90 is inserted therein after removing long leg 92. Then, housing 21 is reassembled and padlock 20 is ready for use as originally constructed.

In this preferred embodiment, as shown in FIGS. 5A-9, long leg 92 of shackle 90 is mounted to housing 21 by shackle retaining screw 130. In addition, shackle retaining screw 130 is preferably hidden by cover 73 of pushbutton 70. As a result, the user must rotate dials 40 into the lock disengaged position, for enabling pushbutton 70 to line up with shackle retaining screw hole 22 of body 21. Once in this position, the user can threadedly disengage shackle retaining screw 130, and then remove long leg 92 of shackle 90 from housing 21. Thereafter, the replacement shackle 90 can be repositioned in housing 21 and securely affixed to housing 21 by replacing screw 130.

By incorporating this additional feature, only the user is able to open housing 21 for removing long leg 92 of shackle 90 and install a replacement shackle into housing 21. In this way, added security is provided to the user.

Figure 23:
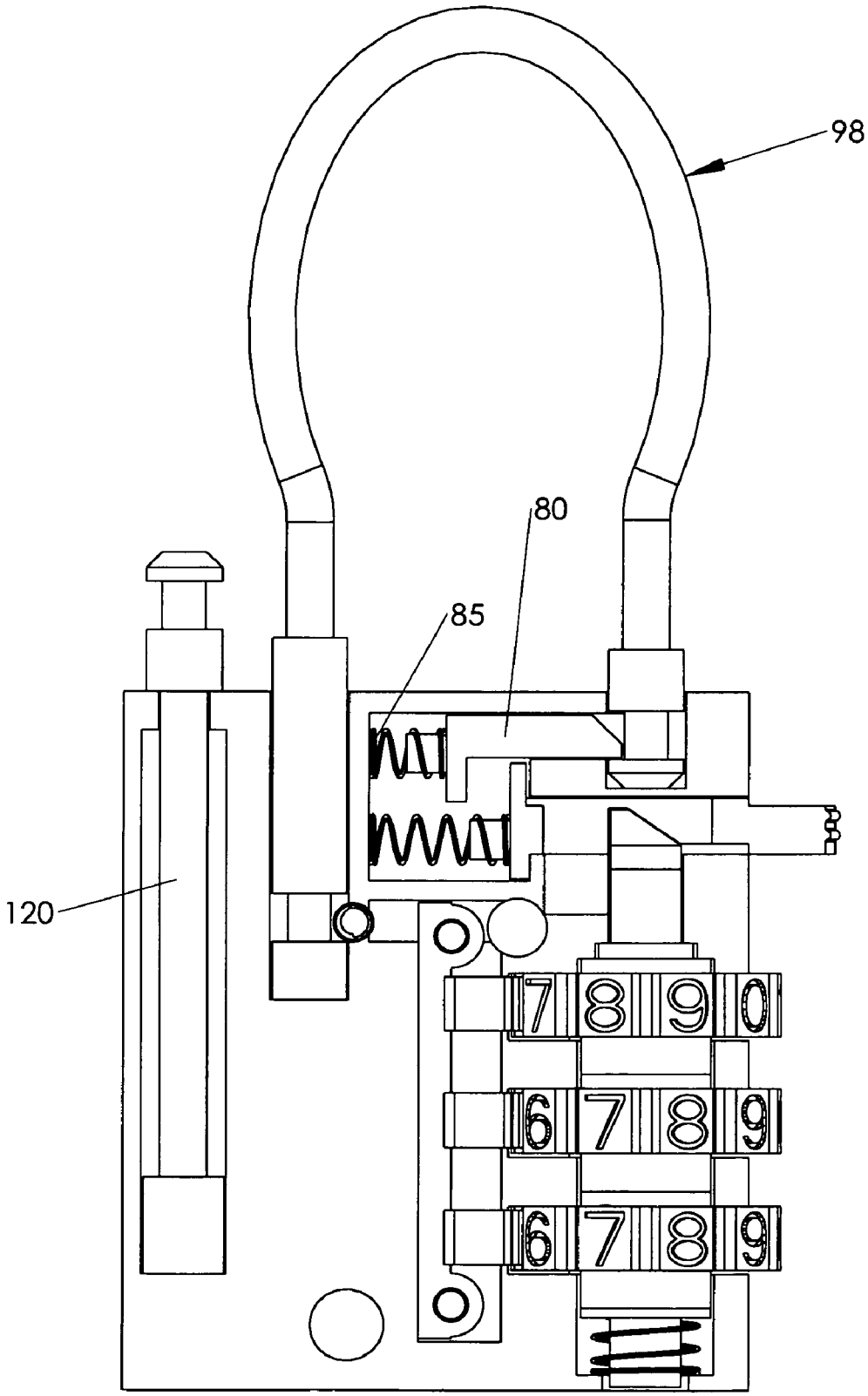
FIG. 23 is a front elevation view of a further alternate embodiment of the padlock of the present invention shown with a front cover removed and incorporating an alternate shackle construction.
Figure 25:
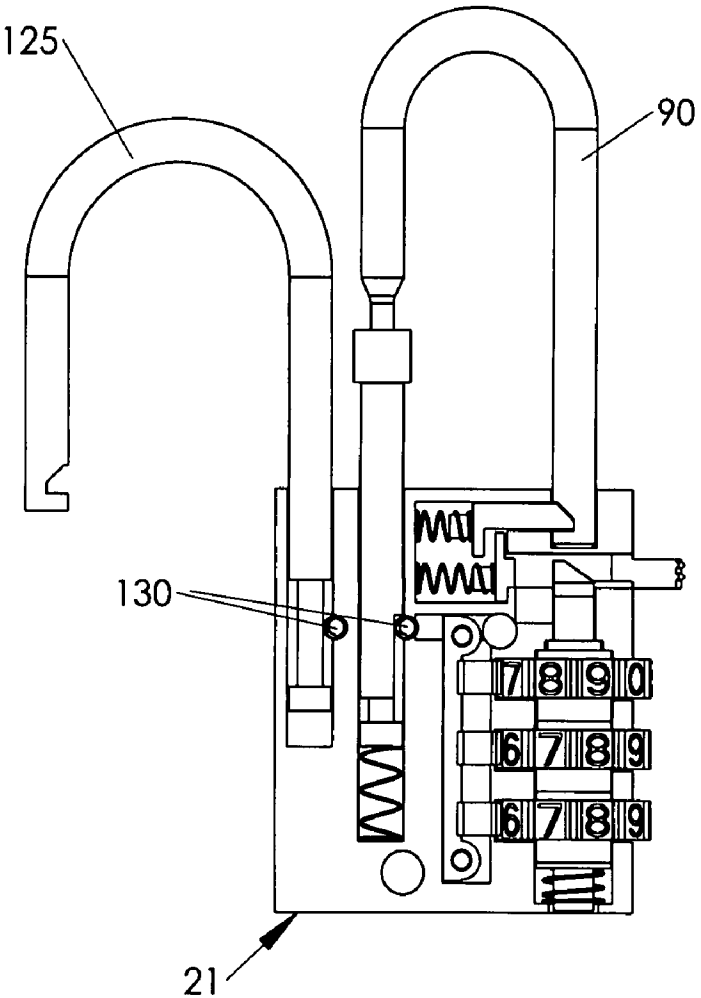
FIG. 25 is a front elevation view of an alternate embodiment of the present invention incorporating further alternate shackle constructions.
Figure 24:
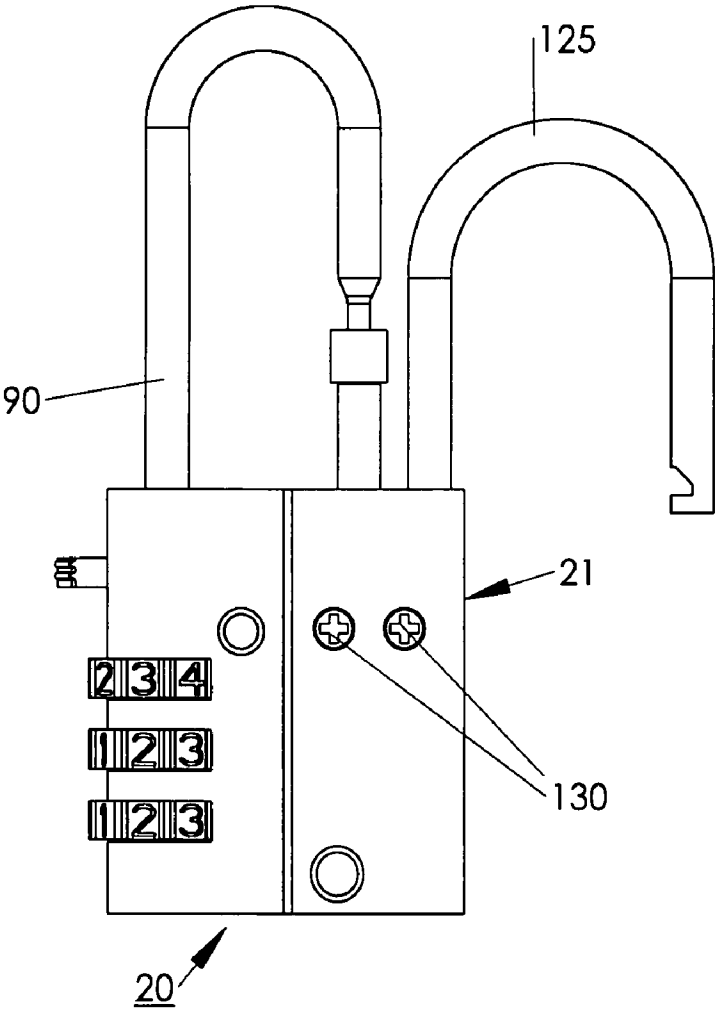
FIG. 24 is a rear elevation view of an alternate embodiment of the present invention incorporating further alternate shackle constructions.
Figure 27:
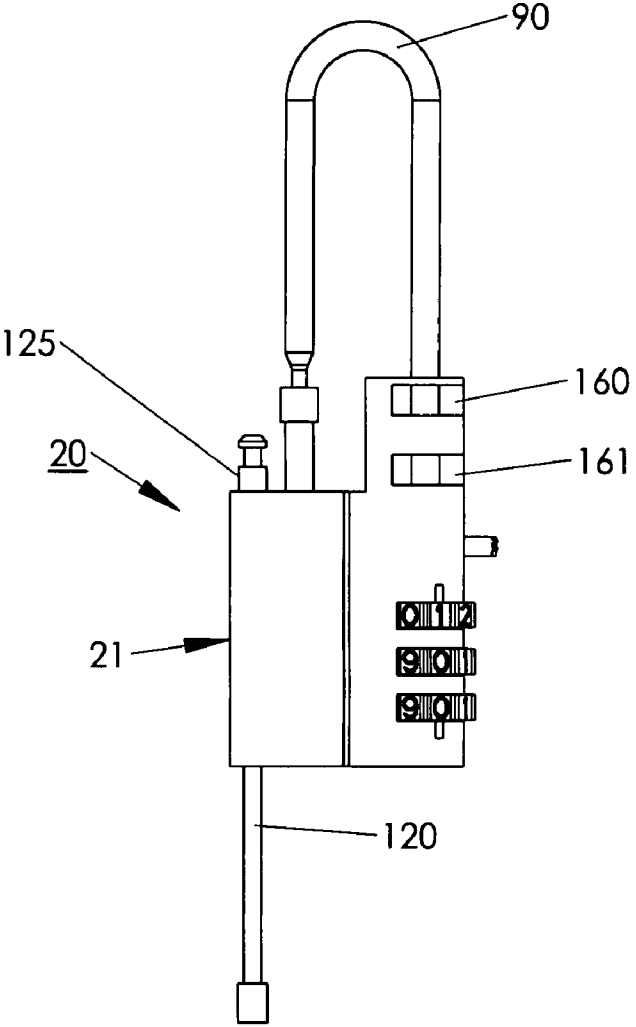
FIG. 27 is a front elevation view of the padlock of FIG. 26.
Figure 26:
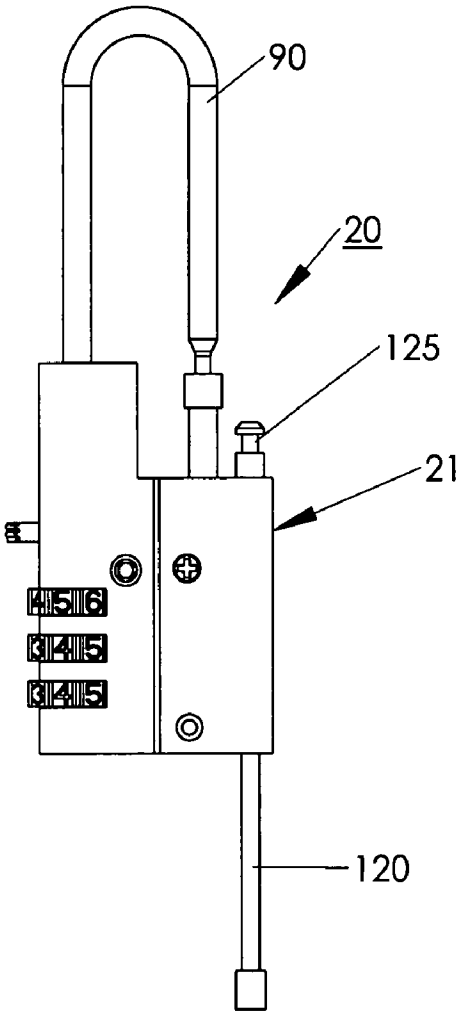
FIG. 26 is a rear elevation view of a further alternate embodiment of the padlock of the present invention wherein the padlock is constructed for use in securely locking zipper pulls.
Figure 28:
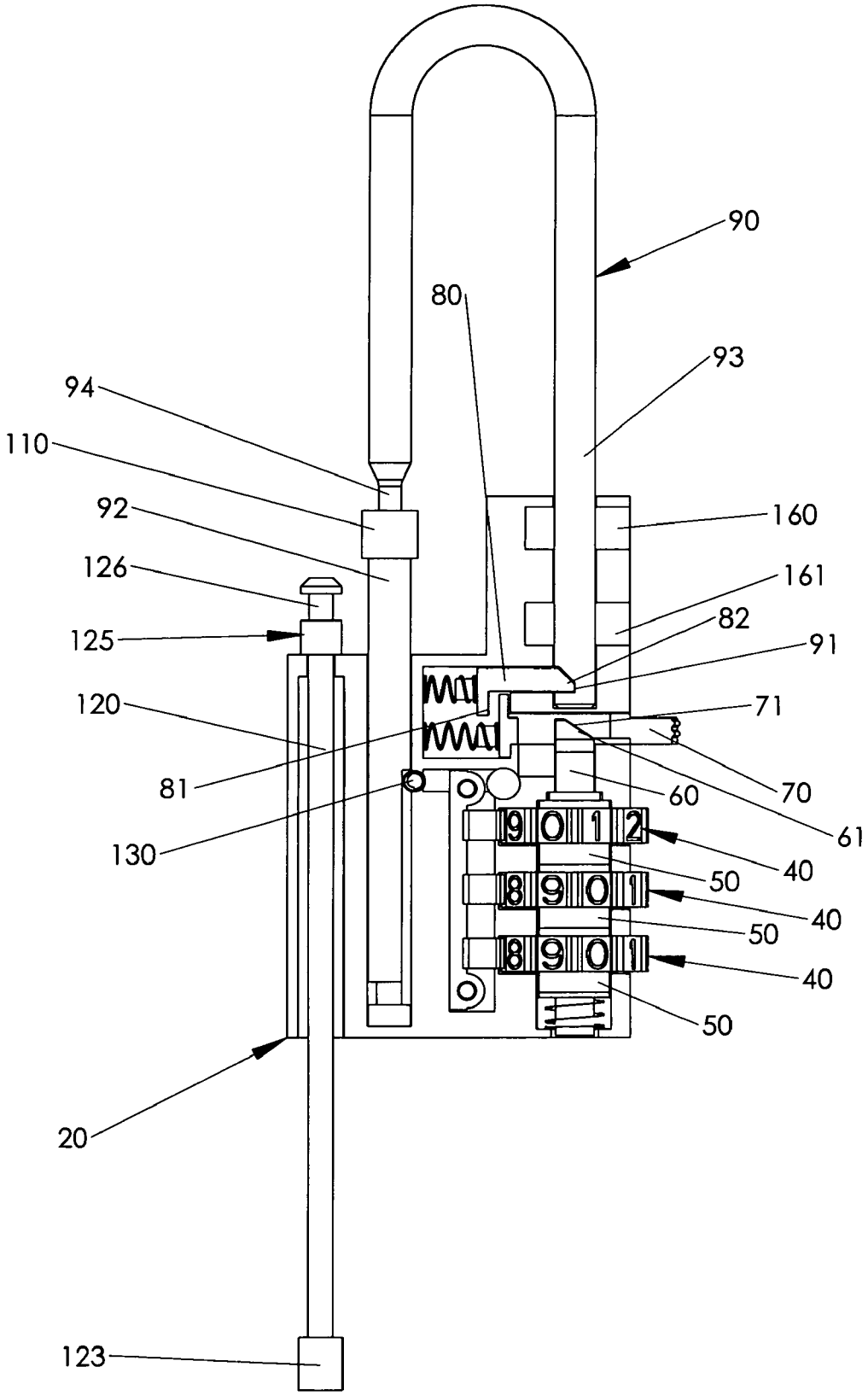
FIG. 28 is a front elevation view of the padlock of FIG. 27 with the cover removed and with the padlock in the locked position.
Figure 29:
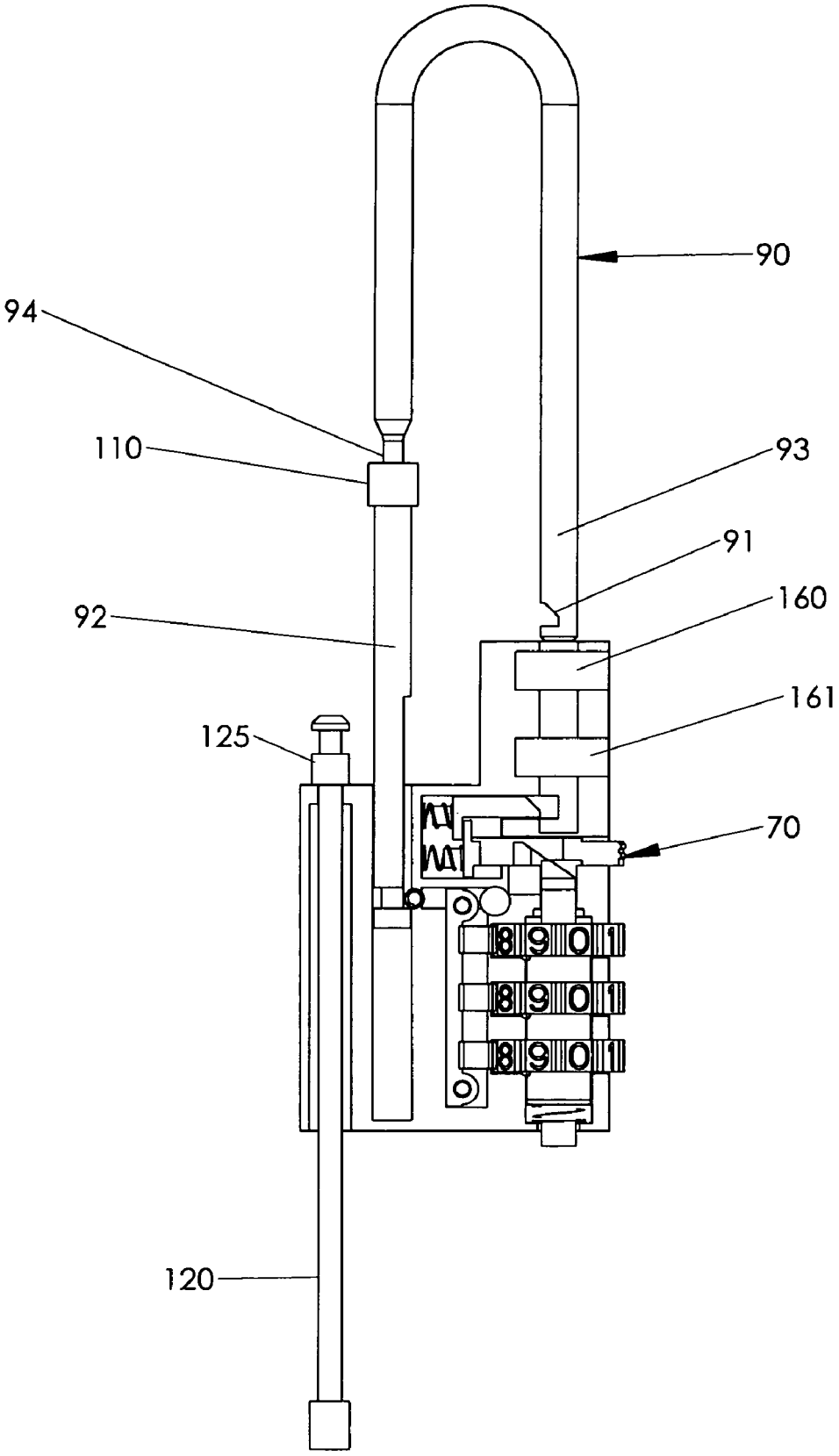
FIG. 29 is a front elevation view of the padlock of FIG. 28 shown in the unlocked position.
Figure 30:
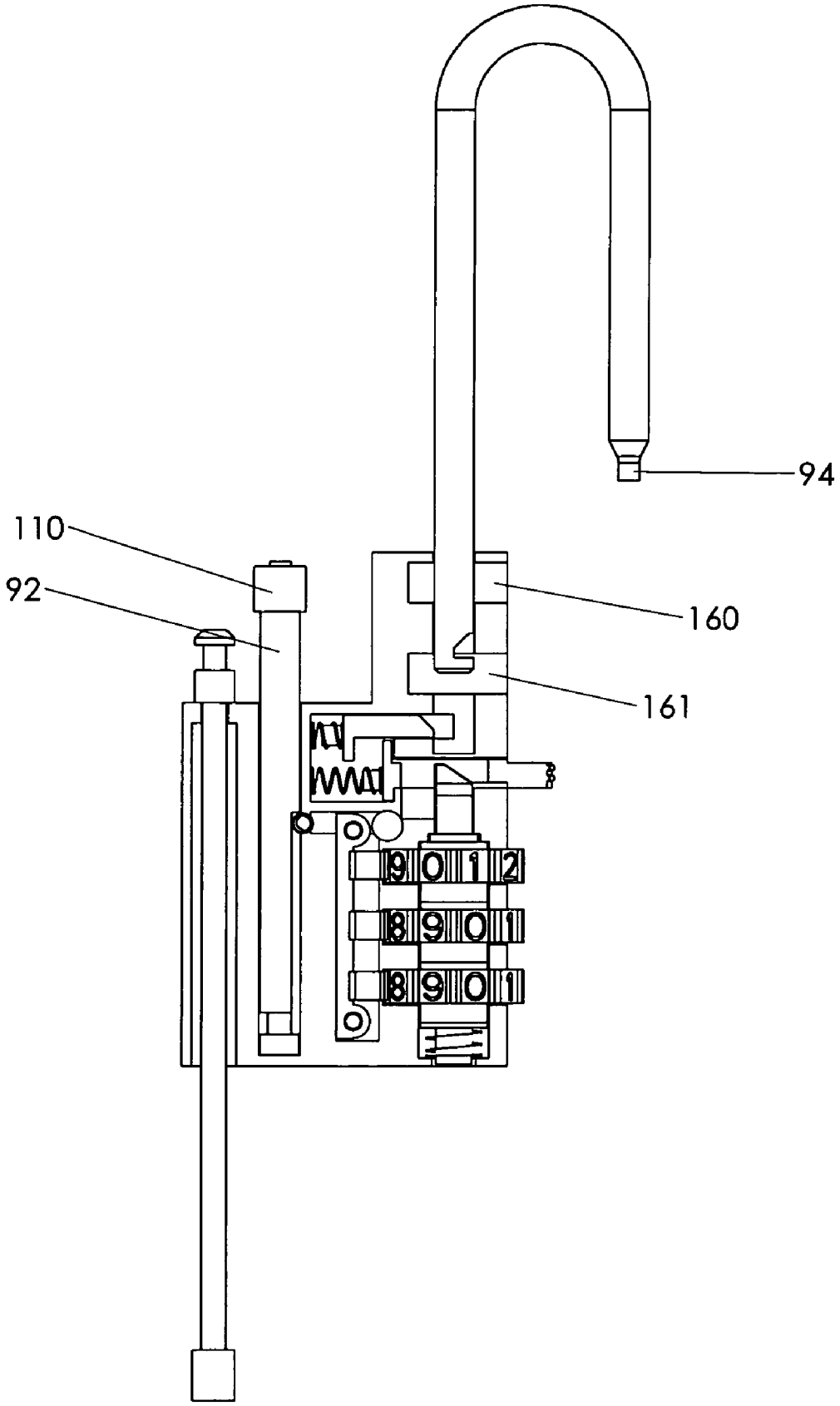
FIG. 30 is a front elevation view of the padlock of FIG. 29 shown with the shackle having been severed and partially removed.

In FIGS. 23-25, two further alternate embodiments of the present invention are depicted. In each of these alternate embodiments, padlock 20 is constructed substantially identically to the embodiment detailed above and shown in FIGS. 1-17 except for the construction of the shackle. In the embodiment shown in FIG. 23, shackle 98 is employed as the primary shackle which is securely mounted to housing 21 at one end thereof and removably engaged with housing 21 at the opposed end. In this embodiment, shackle 98 is constructed principally as a cable member, typically formed of wire material or braided wire elements, enabling shackle 98 to be more flexible. In addition, this construction is typically easier for security personnel to cut whenever opening the suitcase, package, or other item is required.

In the embodiment shown in FIGS. 24 and 25, padlock 20 is constructed with secondary shackle 125 being formed with a J-shaped shackle construction and being positioned for locked engagement therewith, whenever J-shaped shackle 90 has been cut and removed. In this way, secondary shackle 125 can be quickly and easily substituted for shackle 90 whenever secondary shackle 125 is required.

In addition, in the preferred construction of this embodiment, padlock 20 incorporates two shackle retaining screws 130 which are employed to assist the user in changing both primary shackle 90 as well as secondary shackle 125. In this way, whenever shackle 90 has been cut, its removal and replacement can be quickly and easily achieved, as well as replacing secondary shackle 125 whenever needed.

In FIGS. 18-23, an alternate preferred embodiment of padlock 20 of the present invention is depicted. In this embodiment, padlock 20 incorporates housing 21 within which a key controlled locking section is mounted. In this regard, the key controlled locking section comprises cylinder bearing housing 150 within which a rotatable cylinder member is mounted for being activated by a key member. The construction of cylinder bearing housing 150 is well-known in the industry, and is typified by the cylinder construction taught in U.S. Pat. Nos. 7,140,209; 7,269,985 and 7,225,648.

In this embodiment, the rotational movement of the cylinder within cylinder housing 150 is employed to cause slider block 151 to move laterally within housing 21. Furthermore, slider block 151 is mounted in controlling engagement with latch 80, thereby enabling the lateral movement of slider block 151 to cause latch 80 to move in a direction against the force exerted thereon by spring 85.

Padlock 20 also comprises additional components similar to the components incorporated into padlock 20 of the embodiment detailed above in reference to FIGS. 1-17. In this regard, padlock 20 incorporates J-shaped shackle 90 which is constructed for movement between locked engagement with housing 21 and unlocked engagement therewith. In the preferred construction, J-shaped shackle 90 incorporates long leg 92 and short leg 93, with long leg 92 being mounted in locked engagement with housing 21, while also being axially movable relative thereto whenever short leg 93 is disengaged from housing 21.

In order to achieve the locking and unlocking disengagement of shackle 90 with housing 21, short leg 93 of shackle 90 passes through an aperture formed in housing 21 and incorporates a notch 91 formed near the terminating end thereof. Notch 91 is cooperatively associated with latch 80 which is constructed for being moved into and out of locking engagement with notch 91 of short leg 93 of shackle 90.

In addition, as fully detailed above in reference to the earlier embodiment, padlock 20 also incorporates secondary shackle or cable 155 which is mounted in housing 21 and is constructed for axial or longitudinal movement relative to housing 21. As depicted, secondary shackle/cable 155 incorporates free end 156 which is a movable relative to housing 21 and a fixed end 157 which is securely mounted to housing 21.

By employing this construction, cylinder bearing housing 150 is able to receive a designated key for enabling the cylinder mounted therein to be arcuately pivoted relative to housing 150. This arcuate pivoting movement causes slider block 151 to move laterally forcing latch 80 to become disengaged from notch 91, thereby releasing J-shaped shackle 90 from locked engagement with housing 21. In addition, as soon as the key is removed from the cylinder bearing housing 150, slider block 151 returns to its original position which enables spring 85 to cause slider 80 to be returned into latched engagement with J-shaped shackle 90.

In this embodiment, shackle 90 incorporates a reduced diameter neck portion 94 which is constructed for enabling security personnel to easily cut shackle 90 whenever required for inspecting the suitcase or other item to which padlock 20 has been secured. By incorporating reduced diameter neck portion 94 in long leg 92 of shackle 90, inspectors are able to quickly and easily sever shackle 90 for enabling padlock 20 to be easily removed from the suitcase or other package in order to allow the security personnel to gain access to the luggage, suitcase or package.

Figure 20:
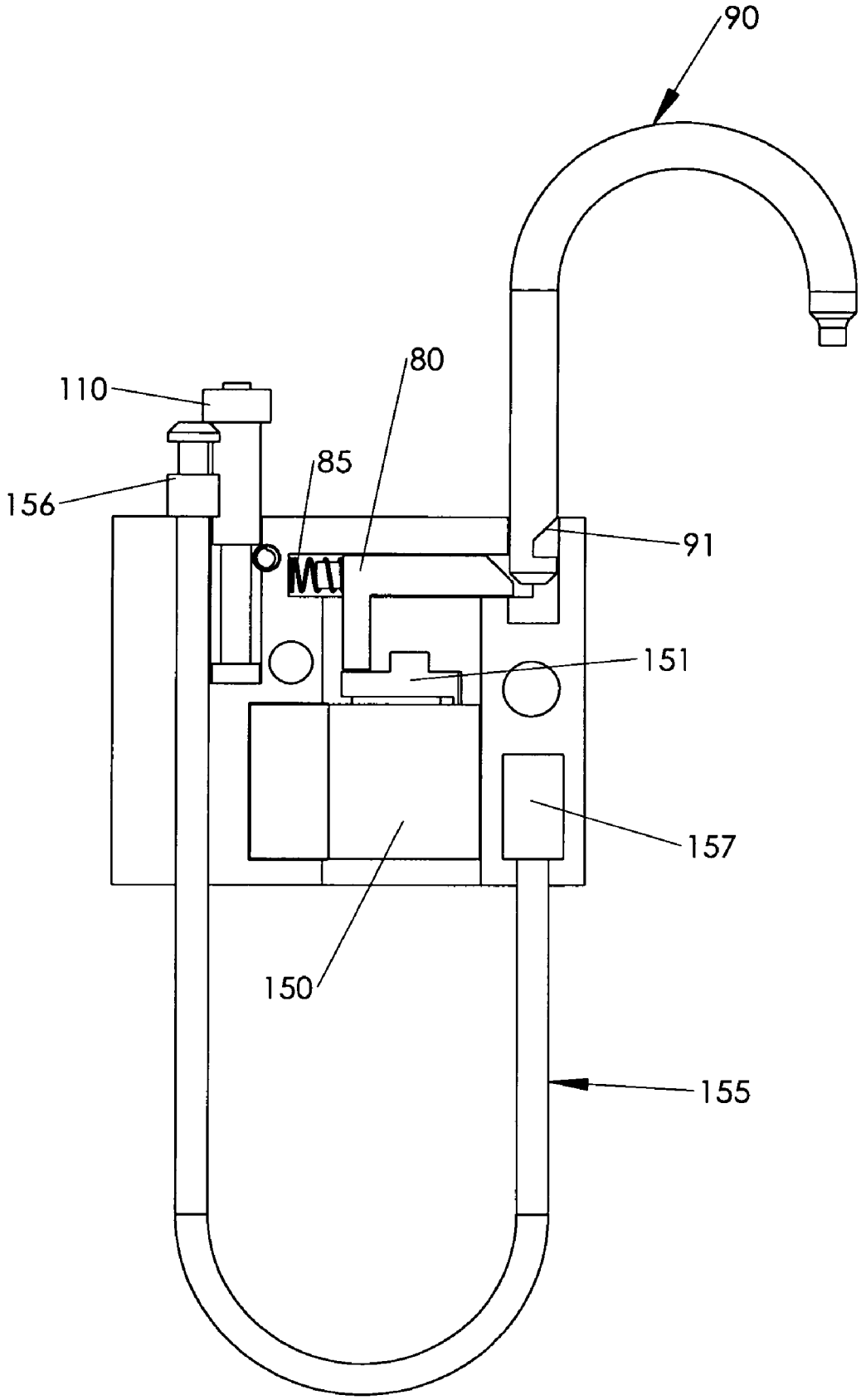
FIG. 20 is a front elevation view of the padlock of FIG. 19, the shackle portion having been severed.
Figure 22:
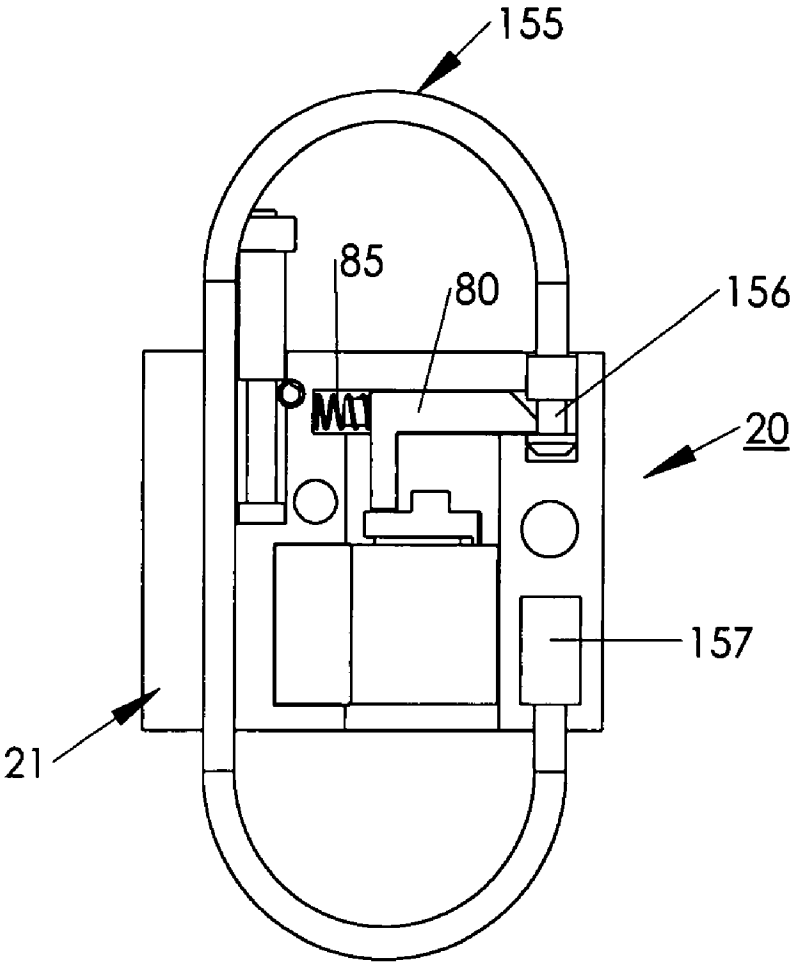
FIG. 22 is a front elevation view of the padlock of FIG. 21.
Figure 21:
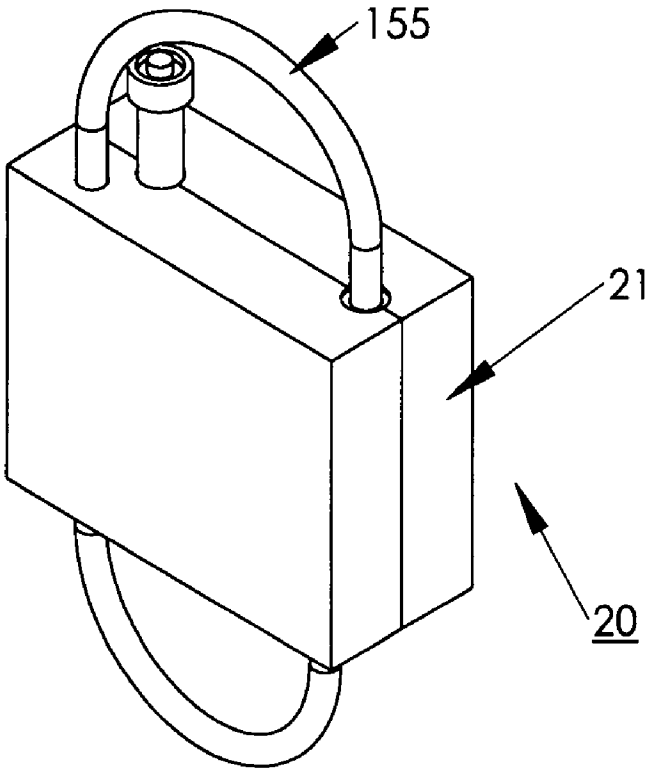
FIG. 21 is a perspective view of the padlock of FIG. 18 with the secondary shackle shown in its locked position.

As shown in FIG. 20, once shackle 90 has been severed or cut in reduced diameter portion 94, short leg 93 of shackle 90 is able to be freely moved in a manner which will enable short leg 93 to become disengaged from housing 21. In this regard, latch 80 which is engaging notch 91 of shackle 90 is mounted in housing 21 independently of any components other than biasing spring 85. As a result, the security officer is able to remove short leg 93 of shackle 90 from housing 21 by merely rotating short leg 93 through an arc of about 180°, which effectively causes latch 80 to be longitudinally or laterally moved in housing 21, and become disengaged from notch 91. Once latch 80 is disengaged, short leg 93 can be removed from housing 21 and thrown away.

Furthermore, long leg 92 of shackle 90 will remain secretly mounted with housing after reduced diameter neck portion 94 has been severed. In order to protect the suitcase, package, as well as any individual from any injury or harm, axially movable collar 110 is mounted to long leg 92 of shackle 90 in direct association with reduced diameter neck portion 94. In this way, once reduced diameter neck portion has been cut and short leg 93 has been removed, axially movable collar 110 can be raised to peripherally surround the area where neck portion 94 has been severed. In this way, collar 110 peripherally surrounds any jagged edges that may exist, preventing contact between the jagged edges and the suitcase or individuals and preventing any damage or injury.

Once a security officer has completed his inspection of the suitcase, package, or other item, this embodiment of padlock 20 is quickly and easily re-locked on the suitcase in order to protect the contents of the suitcase. In this regard, padlock 20 is re-locked by the security officer by employing secondary shackle 155. As detailed above and shown in FIGS. 21 and 22, secondary shackle 155 comprises an elongated length and is mounted to housing 21 for being longitudinally movable relative thereto. By employing free end 156 and longitudinally extending secondary shackle 155 from housing 21, free end 156 is quickly and easily used by the security personnel to secure the suitcase, package, or other item by inserting free end 156 into housing 21 for being secured in engagement with latch 80. Once latch 80 is fully engaged with free end 156, the suitcase, luggage, package, or other item is fully locked, for securing the contents thereof from unwanted access by unauthorized individuals.

In addition, once a user receives the suitcase, the user immediately recognizes that the suitcase has been inspected due to the presence of the secondary shackle in locked engagement with housing 21. In addition, since the user controlled key remains in the user's possession, the user is able to quickly and easily remove padlock 20 from the suitcase, by merely inserting the appropriate key into cylinder bearing housing 150 and opening padlock 20. Furthermore, whenever the user wishes to remove the severed long leg 92 of shackle 90 and reinsert a new shackle 90 in its place, the user merely removes shackle retaining screw 158 to enable housing 21 to be separated into two components. When separated, replacement shackle 90 is easily inserted into position, after removing long leg 92, and then the padlock is reassembled for enabling padlock 20 to be ready for continued use.

In FIGS. 26-33, a further alternate embodiment for padlock 20 of the present invention is fully depicted. In this embodiment, padlock 20 is constructed for employment in suitcases, briefcases and the like incorporating zippers. In order to enable the terminating ends of the zipper pulls to be a locked with padlock 20, housing 21 of padlock 20 incorporates receiving holes or slots 160 and 161 within which the zipper pulls are easily positioned and retained. In addition, shackle 90 is constructed for passage through the apertures formed in the zipper pulls, in order to securely lock the zipper pulls in padlock 20.

Figure 31:
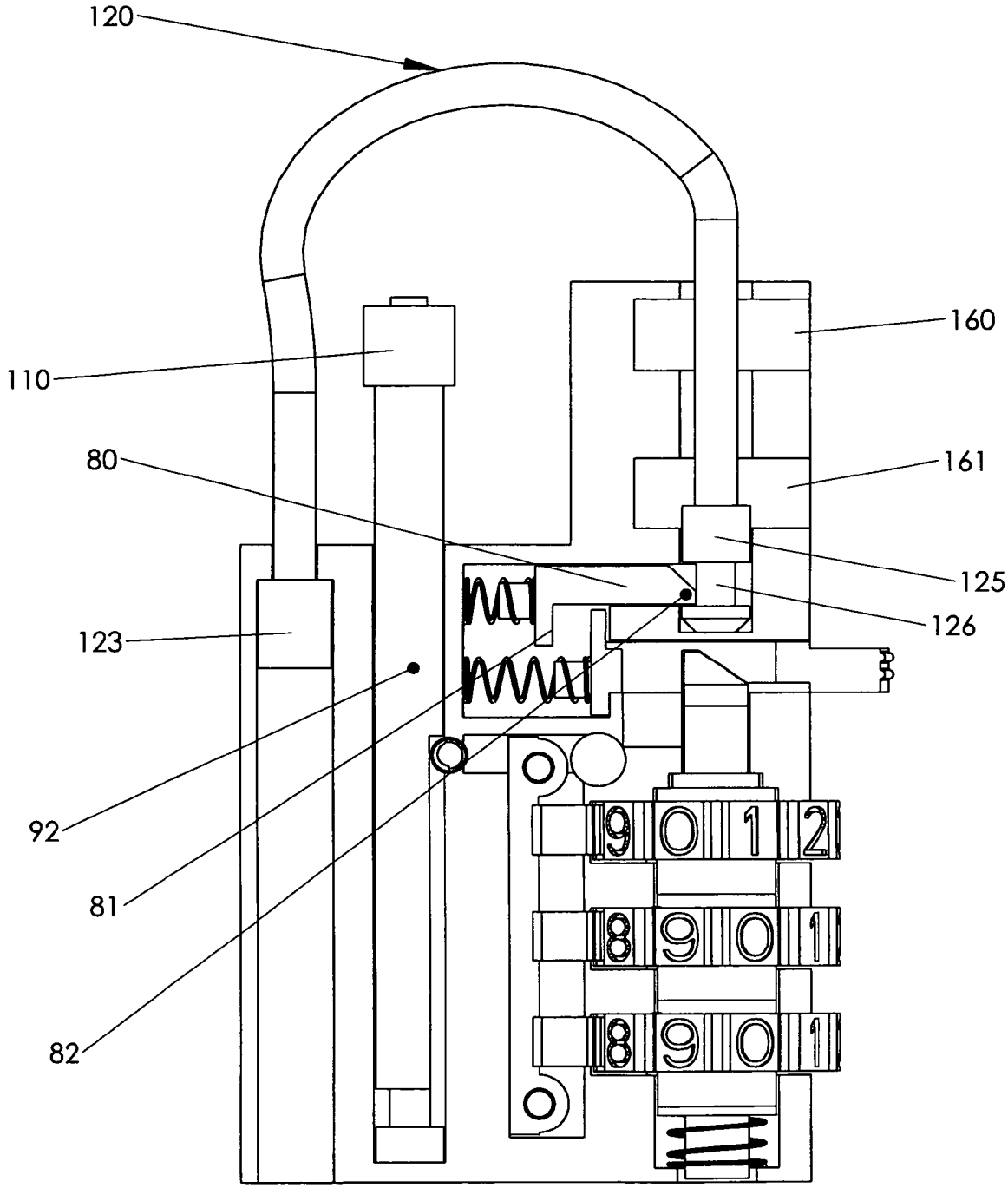
FIG. 31 is a front elevation view of the padlock of FIG. 30 shown with the secondary shackle in the locked position.

In accordance with this embodiment of the present invention, the overall construction and operation of padlock 20 is substantially identical to the embodiment detailed above. In use, a security officer would sever reduced diameter neck portion 94 of shackle 90 in order to gain access to the suitcase, briefcase, or the like and would remove short leg 93 in a manner detailed above and shown in FIG. 30. Once inspection is complete, the secondary shackle 120 is employed for being advanced through the apertures of the zipper pulls for securing padlock 20 to the suitcase or briefcase in locked engagement therewith, as shown in FIG. 31. As depicted in this embodiment, secondary shackle 120 comprises a substantially longer shaft, in order to accommodate the zipper pull construction and enable the security officer to easily insert the elongated secondary shackle 120 through the apertures of the zipper pulls and lock free end 125 in latch 80 of padlock 20.

Figure 32:
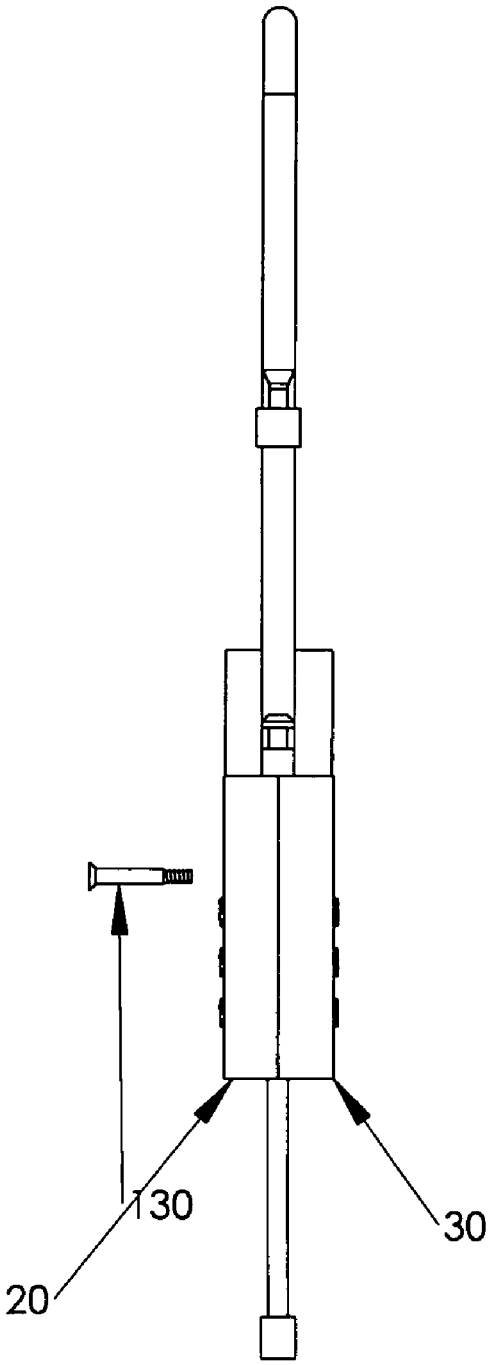
FIG. 32 is a side elevation view of the padlock of FIG. 30.
Figure 33:
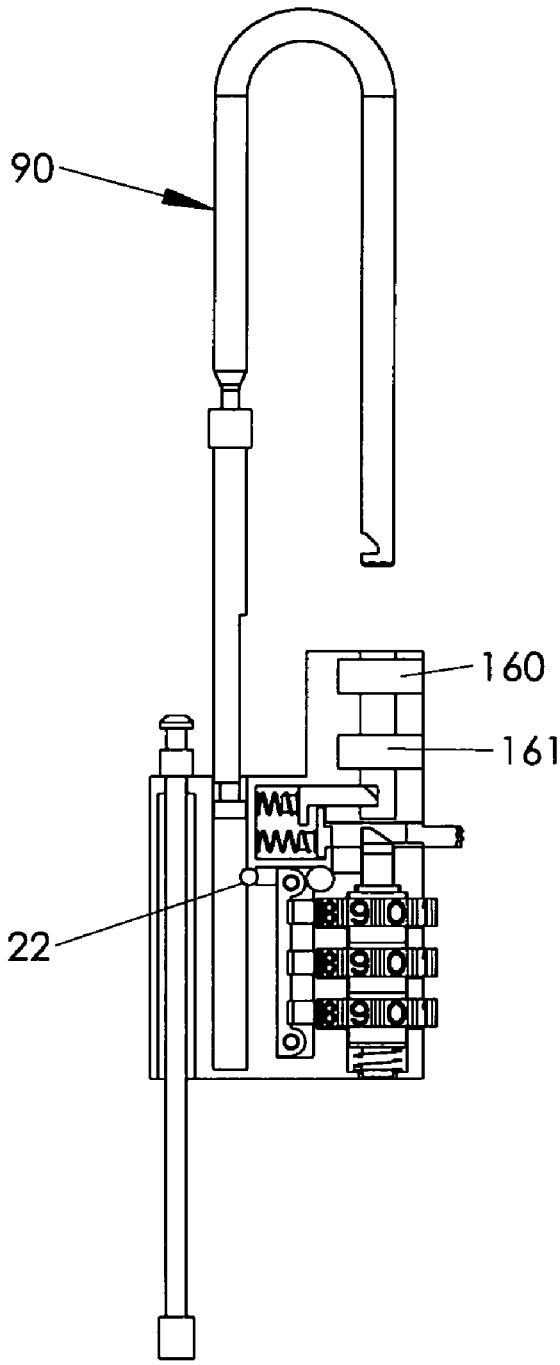
FIG. 33 is a front elevation view of the padlock of FIG. 30 shown in the process of having the primary shackle re-installed.
Figure 34:
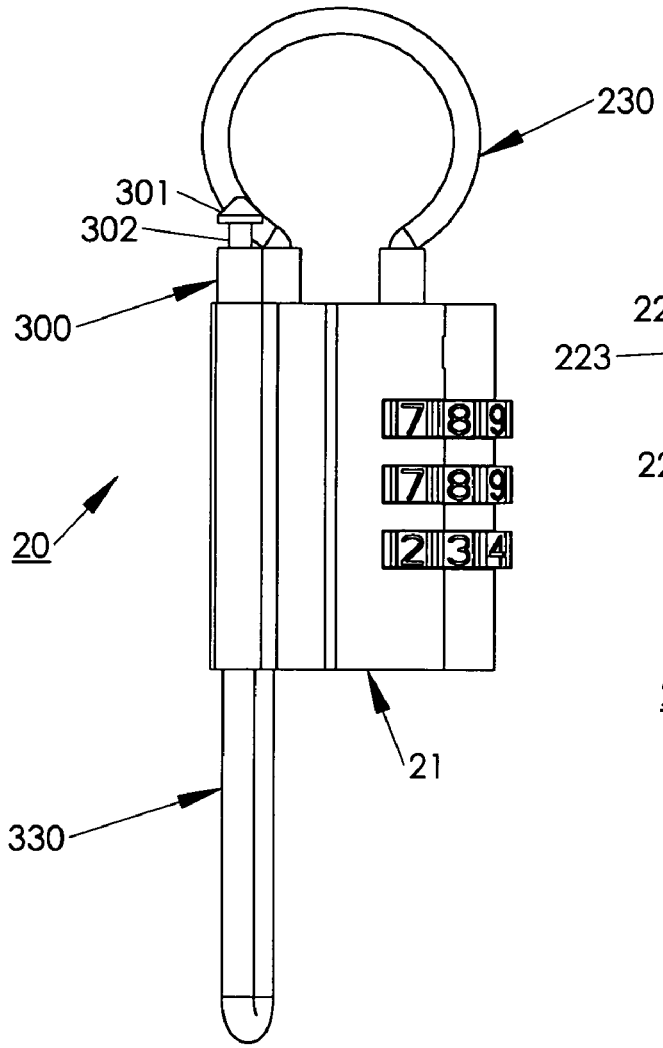
FIG. 34 is a front elevation view of a further alternate embodiment of the padlock of the present invention shown in the closed and locked position and incorporating a combination controlled locking section.
Figure 35:
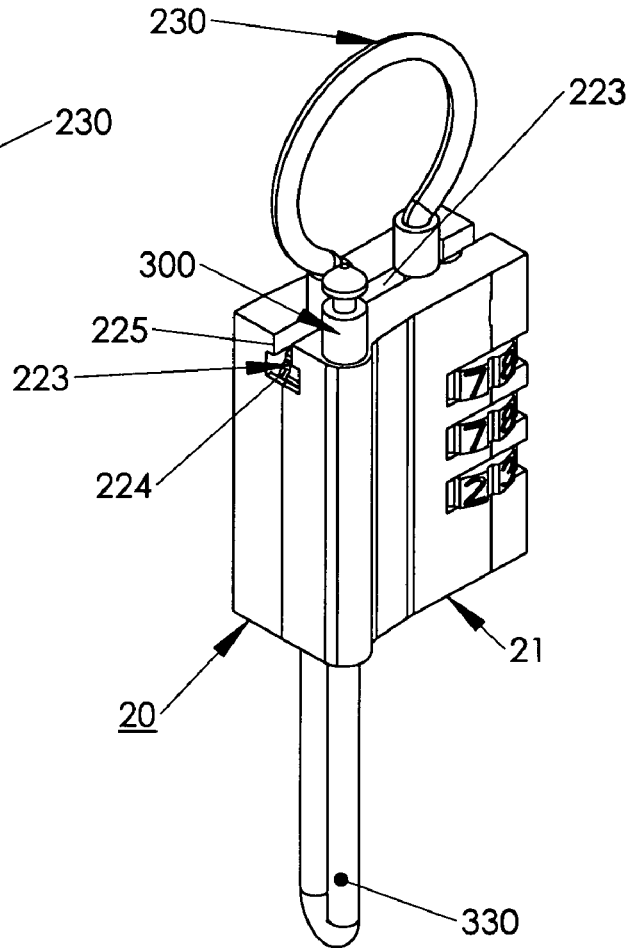
FIG. 35 is a perspective view of the padlock of FIG. 34.
Figure 36:
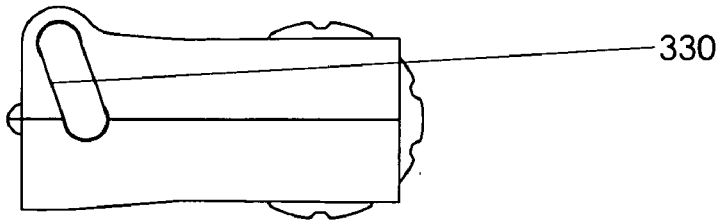
FIG. 36 is a top plan view of the padlock of FIG. 34.
Figure 37:
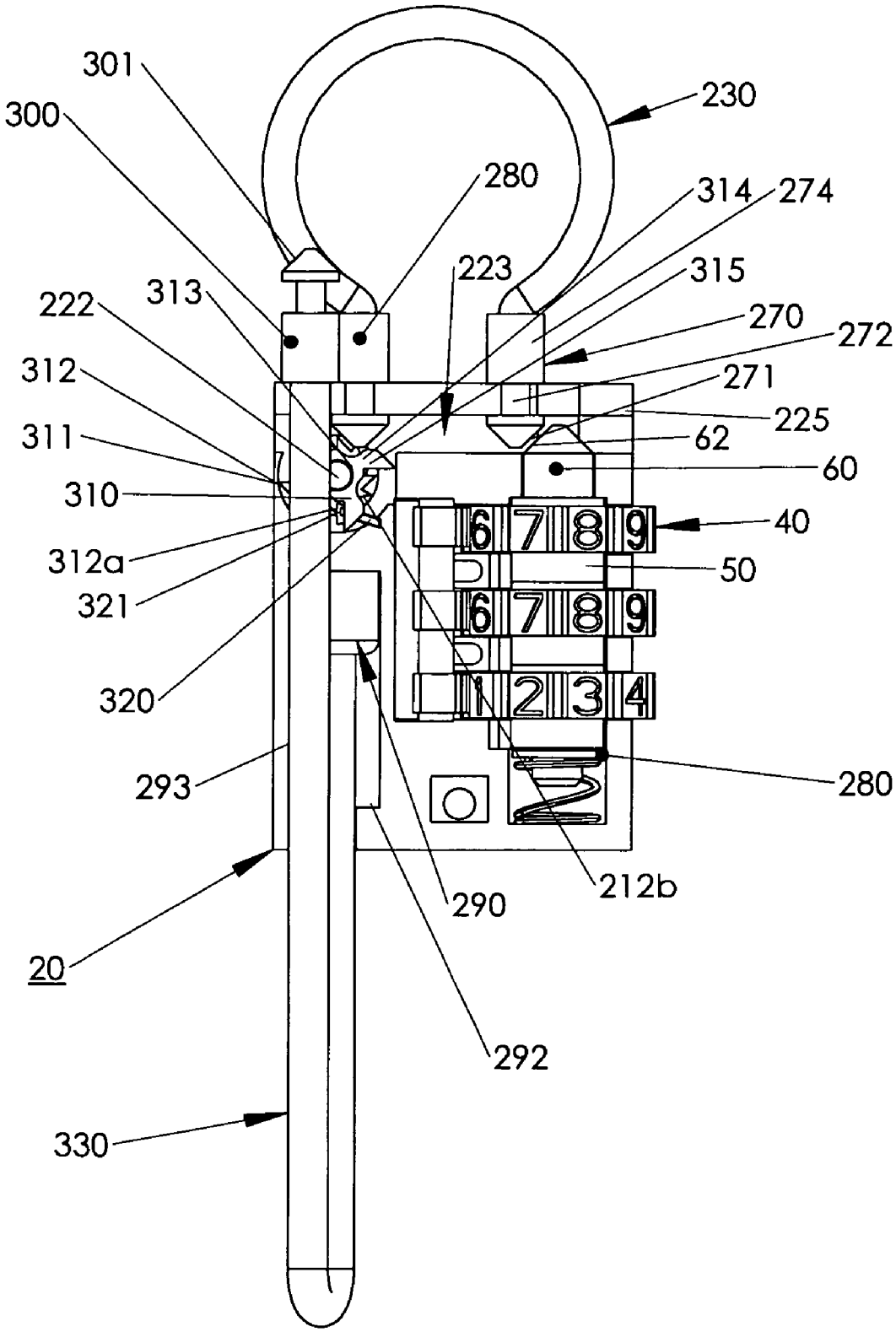
FIG. 37 is a front elevation view of the padlock of FIG. 34 shown with the cover portion of the housing removed.
Figure 38:
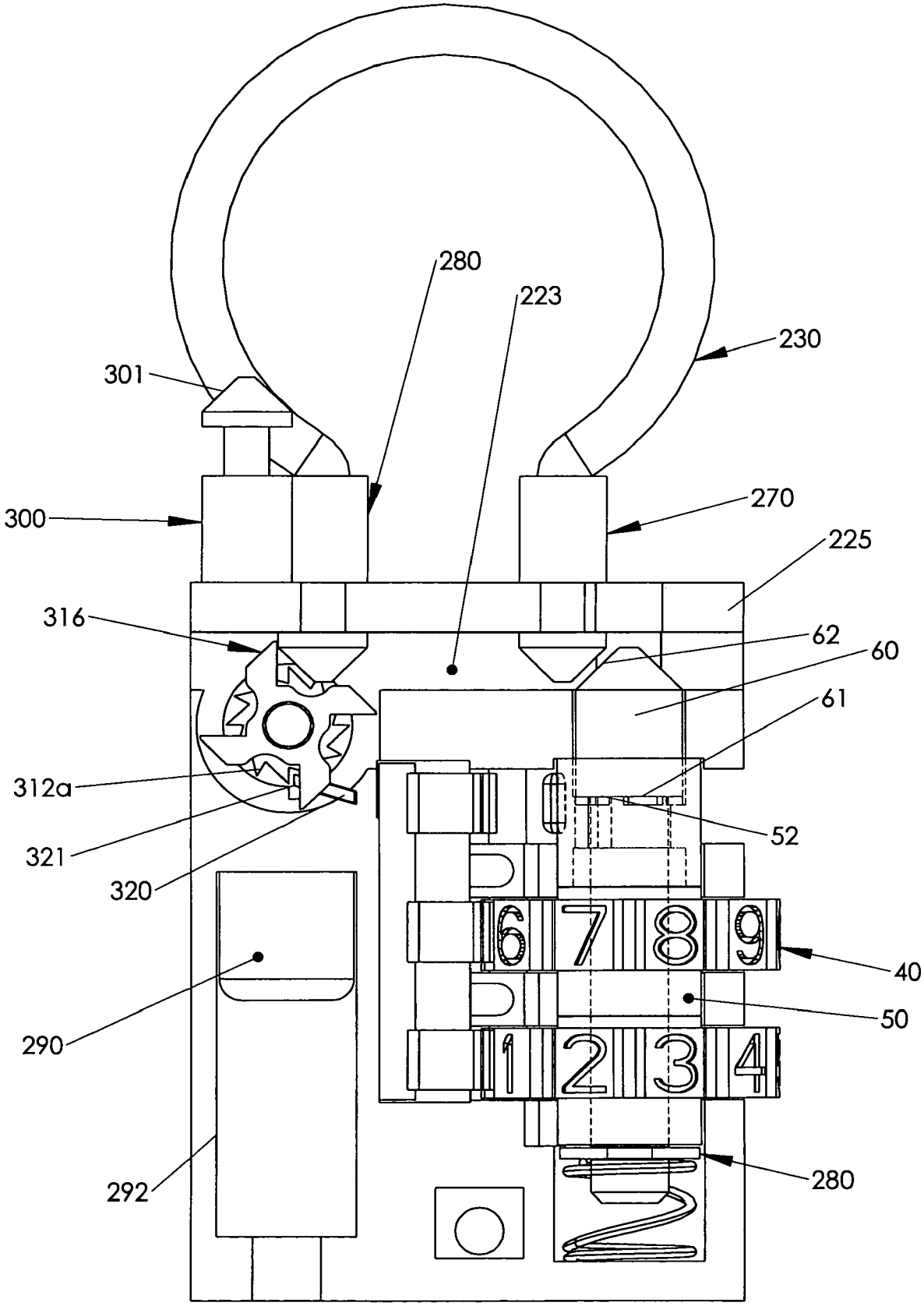
FIG. 38 is a greatly enlarged front elevation view of the padlock as shown in FIG. 37 with a portion of the secondary shackle removed to show greater detail.
Figure 39A:
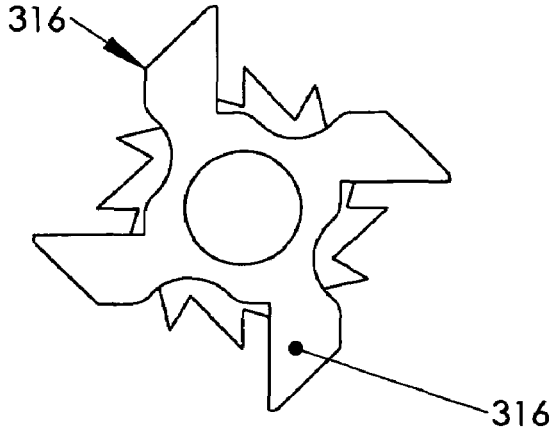
FIG. 39A is a side elevation view of the ratchet wheel/ring member forming a component of this embodiment of the padlock of the present invention.
Figure 39B:
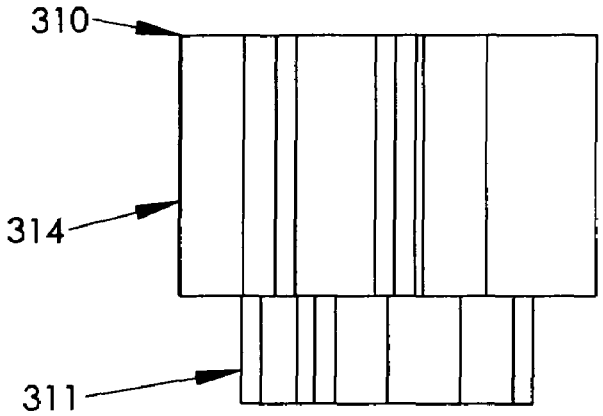
FIG. 39B is a top plan view of the ratchet wheel/ring member of FIG. 39A.
Figure 39C:
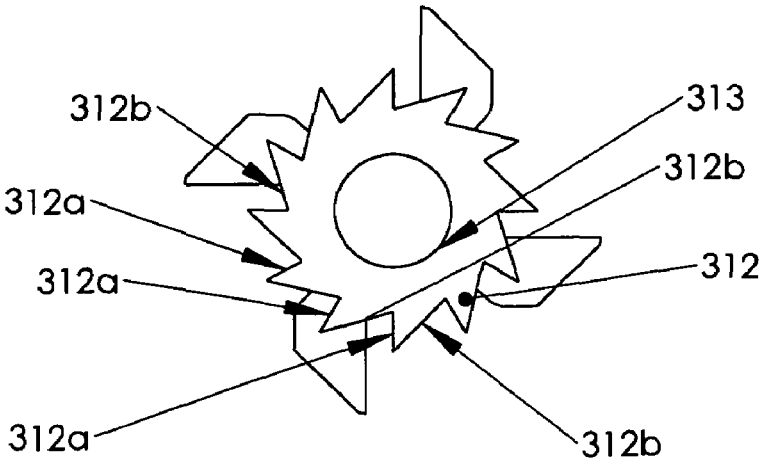
FIG. 39C is a side elevation view of the opposed side of the ratchet wheel/ring member of FIG. 39A.
Figure 39D:
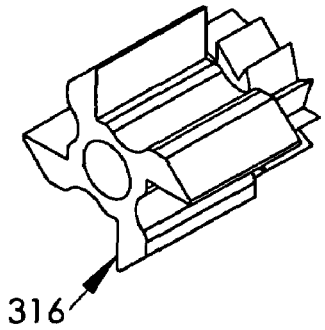
FIG. 39D is a perspective view of the ratchet wheel/ring member of FIG. 39A.
Figure 40A:
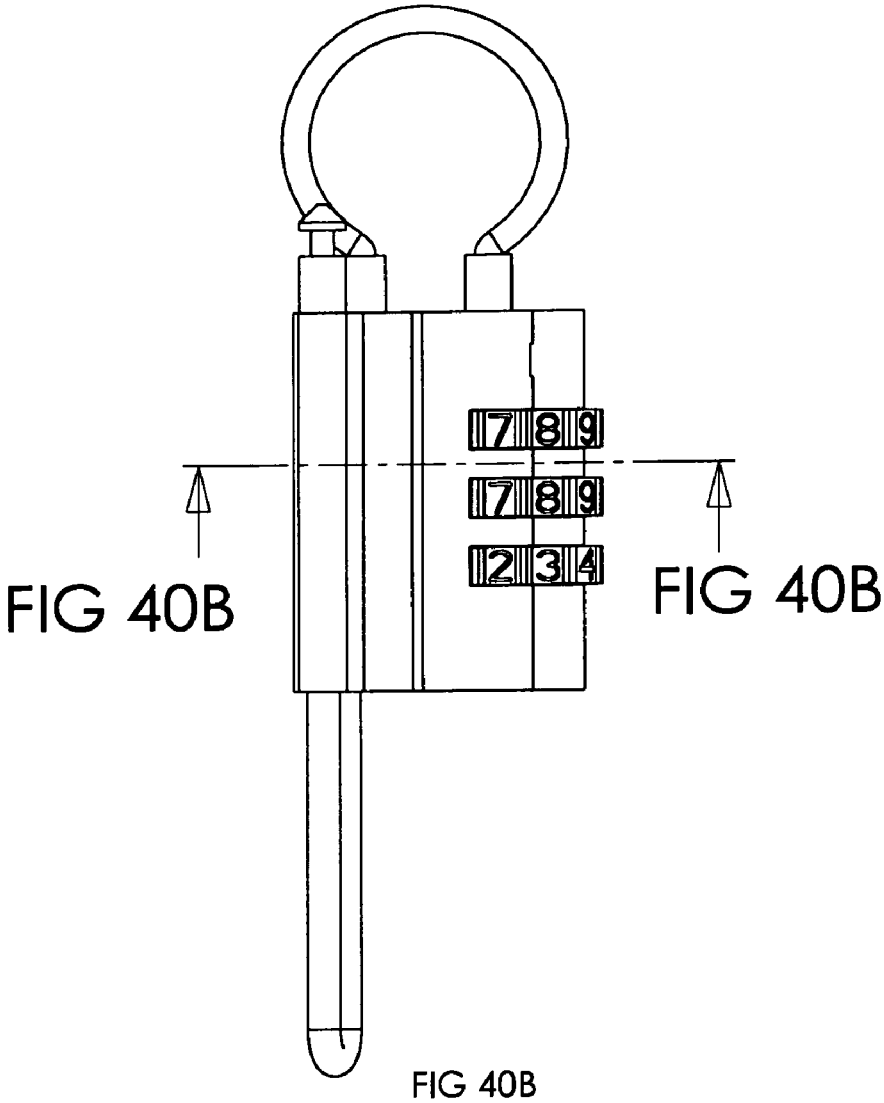
FIG. 40A is a front elevation view of the padlock of FIG. 34.
Figure 40B:
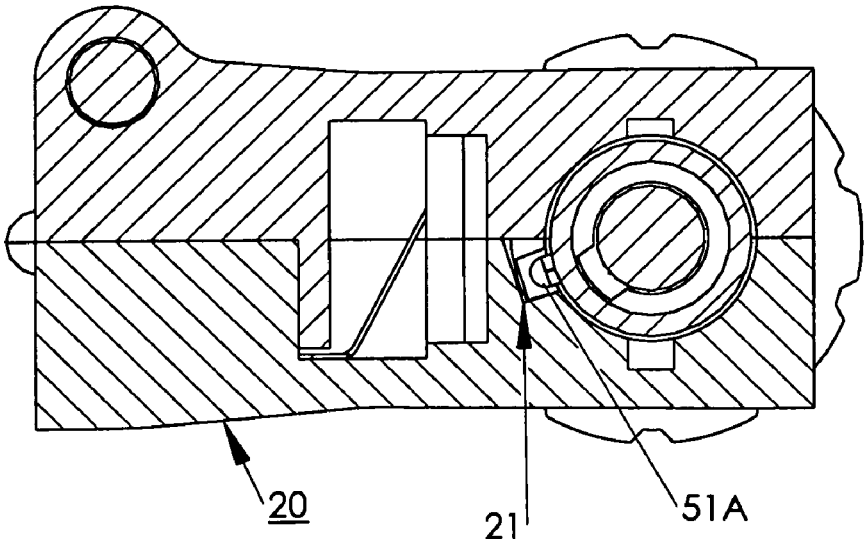
FIG. 40B is a cross-sectional plan view of the padlock of FIG. 40A taken along the line 40B-40B.
Figure 41:
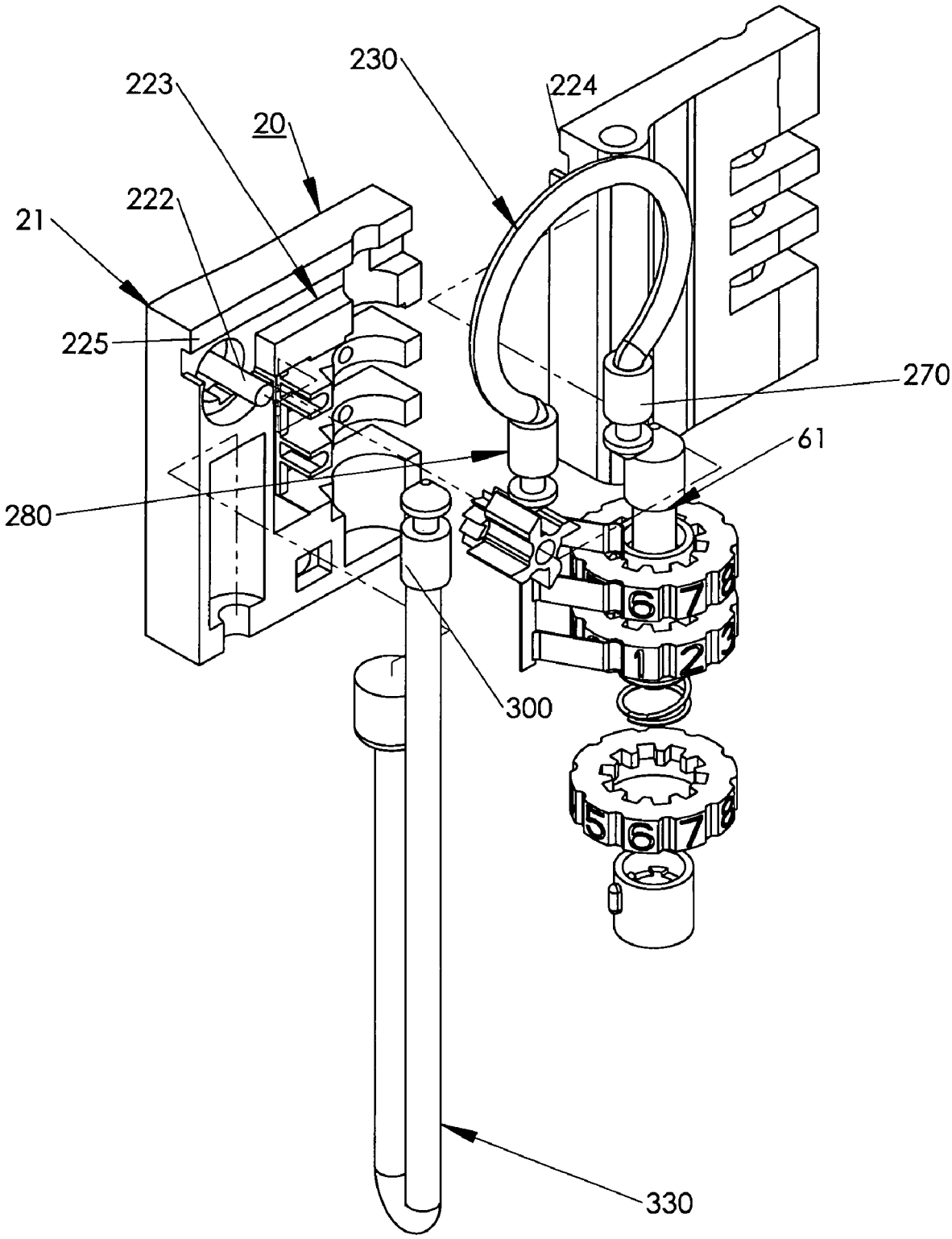
FIG. 41 is an exploded perspective view of the padlock of FIG. 34.
Figure 42:
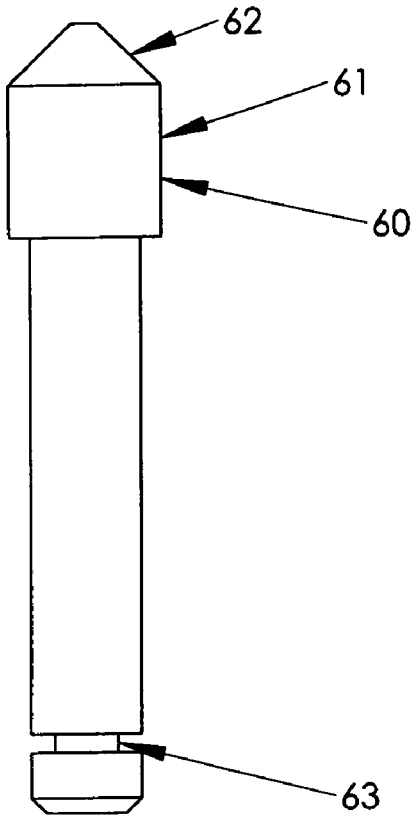
FIG. 42 is a side elevation view of the shackle forming components of the padlock of FIG. 34.
Figure 43A:
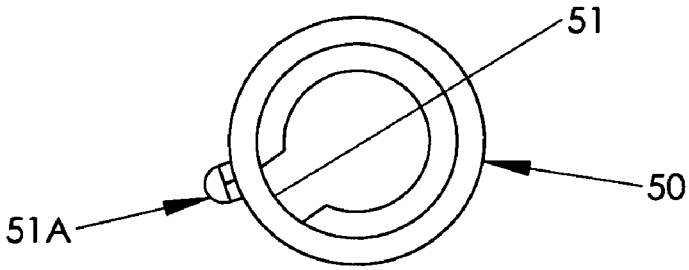
FIG. 43A is a top plan view of a clutch wheel forming a component of the padlock of FIG. 34.
Figure 43B:
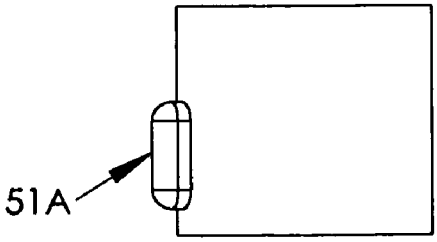
FIG. 43B is a side elevation view of the clutch wheel of FIG. 43A.
Figure 44:
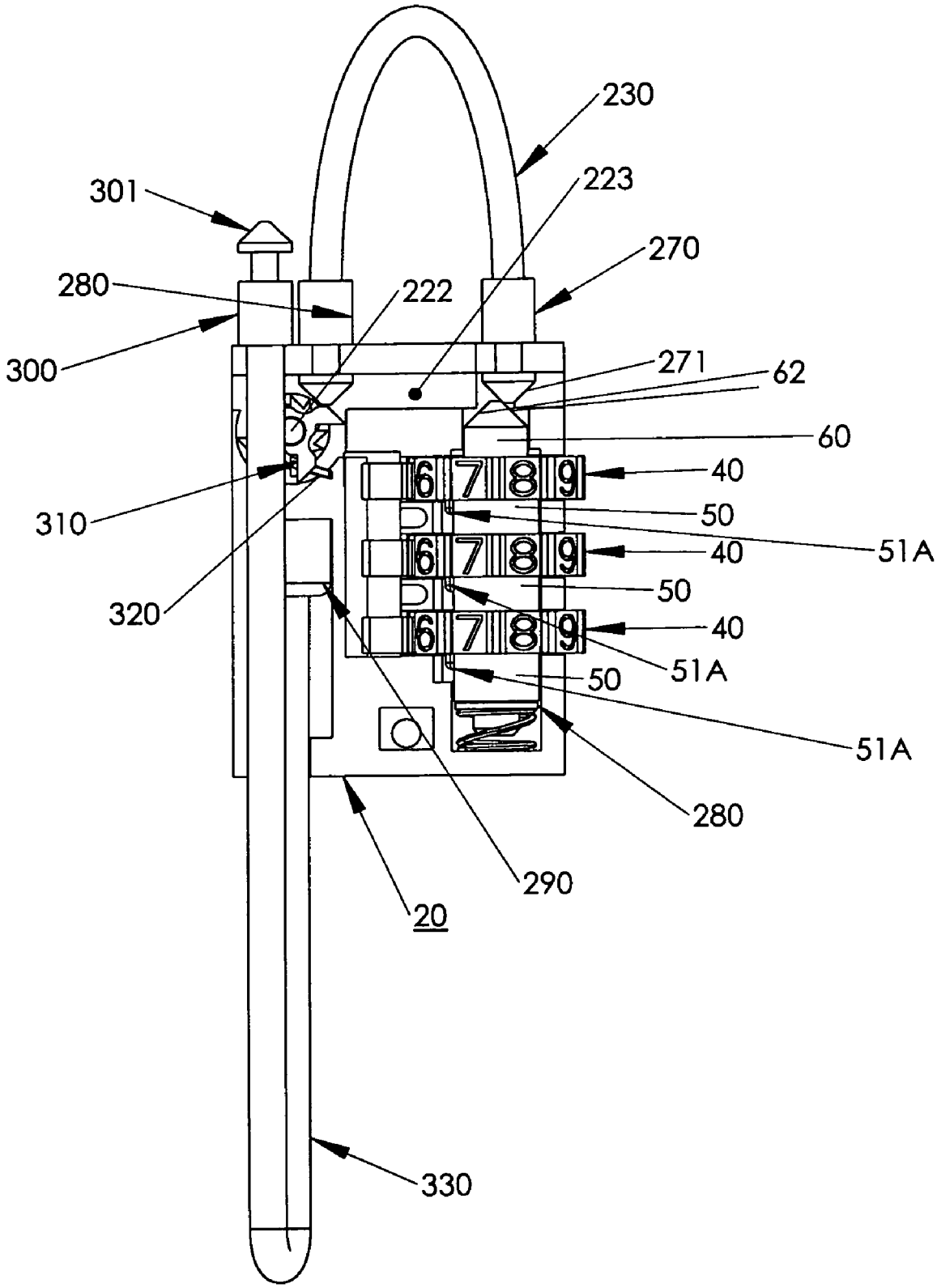
FIG. 44 is a side elevation view of the padlock of FIG. 34 shown with the cover portion of the housing removed and with the padlock in the open position.
Figure 45:
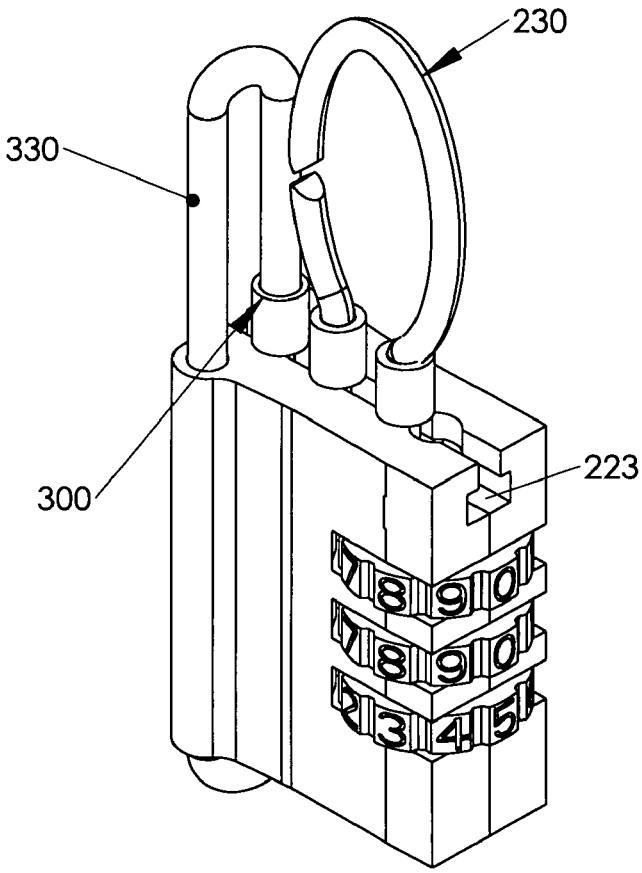
FIG. 45 is a perspective view of the padlock of FIG. 34 shown with the primary shackle severed.
Figure 46:
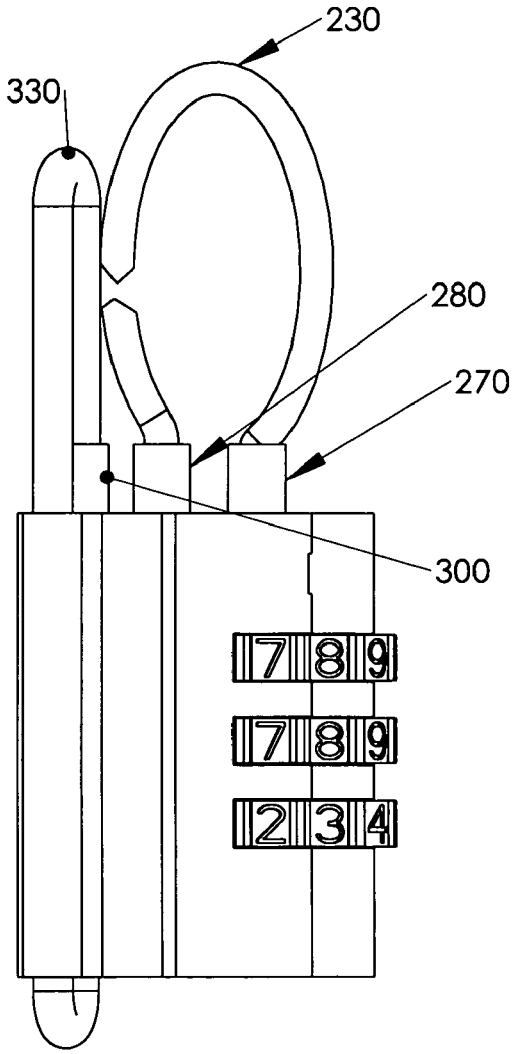
FIG. 46 is a side elevation view of the padlock of FIG. 45.
Figure 47:
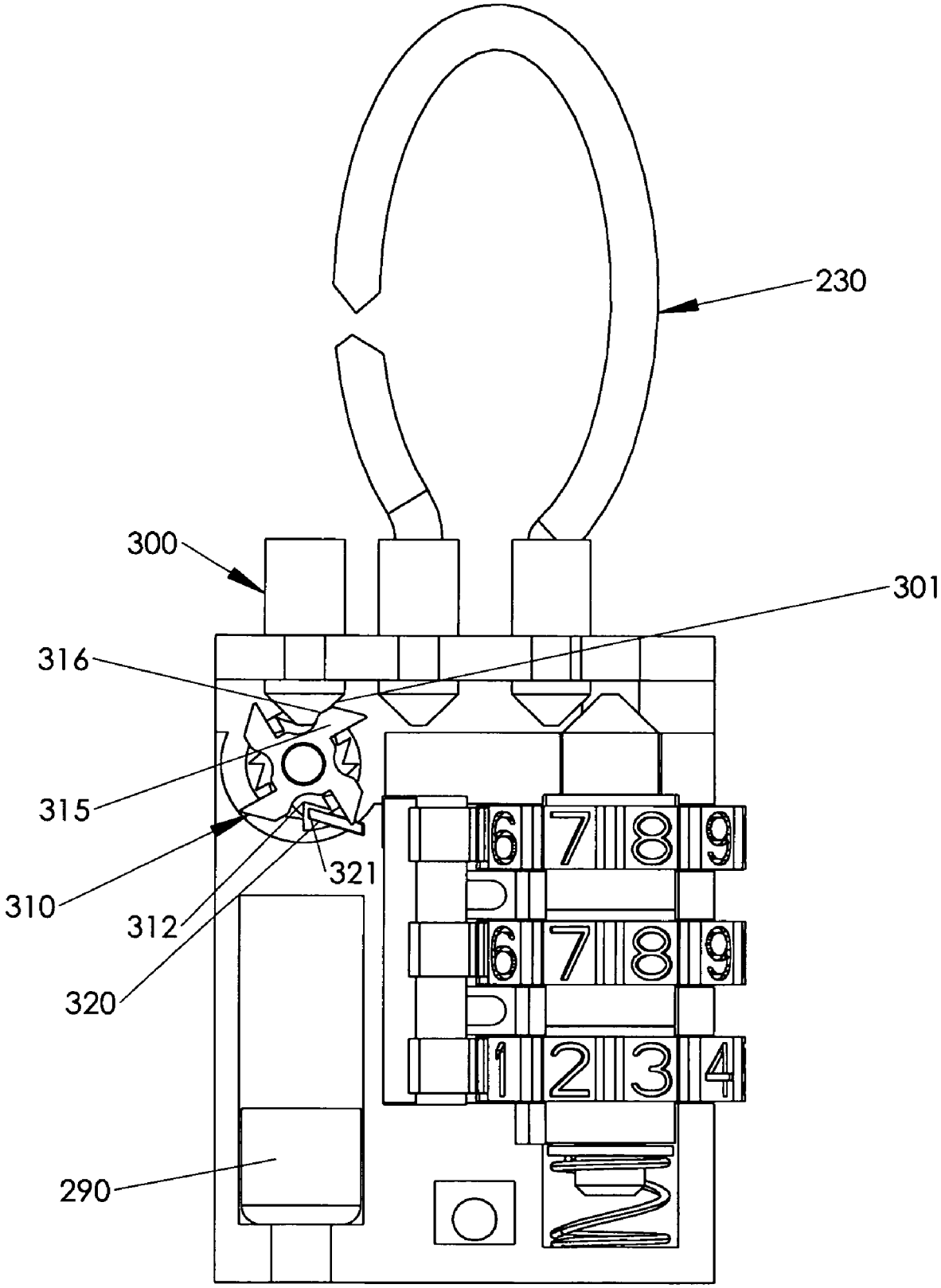
FIG. 47 is a side elevation view of the padlock of FIG. 45 shown with the cover portion of the housing removed.
Figure 48:
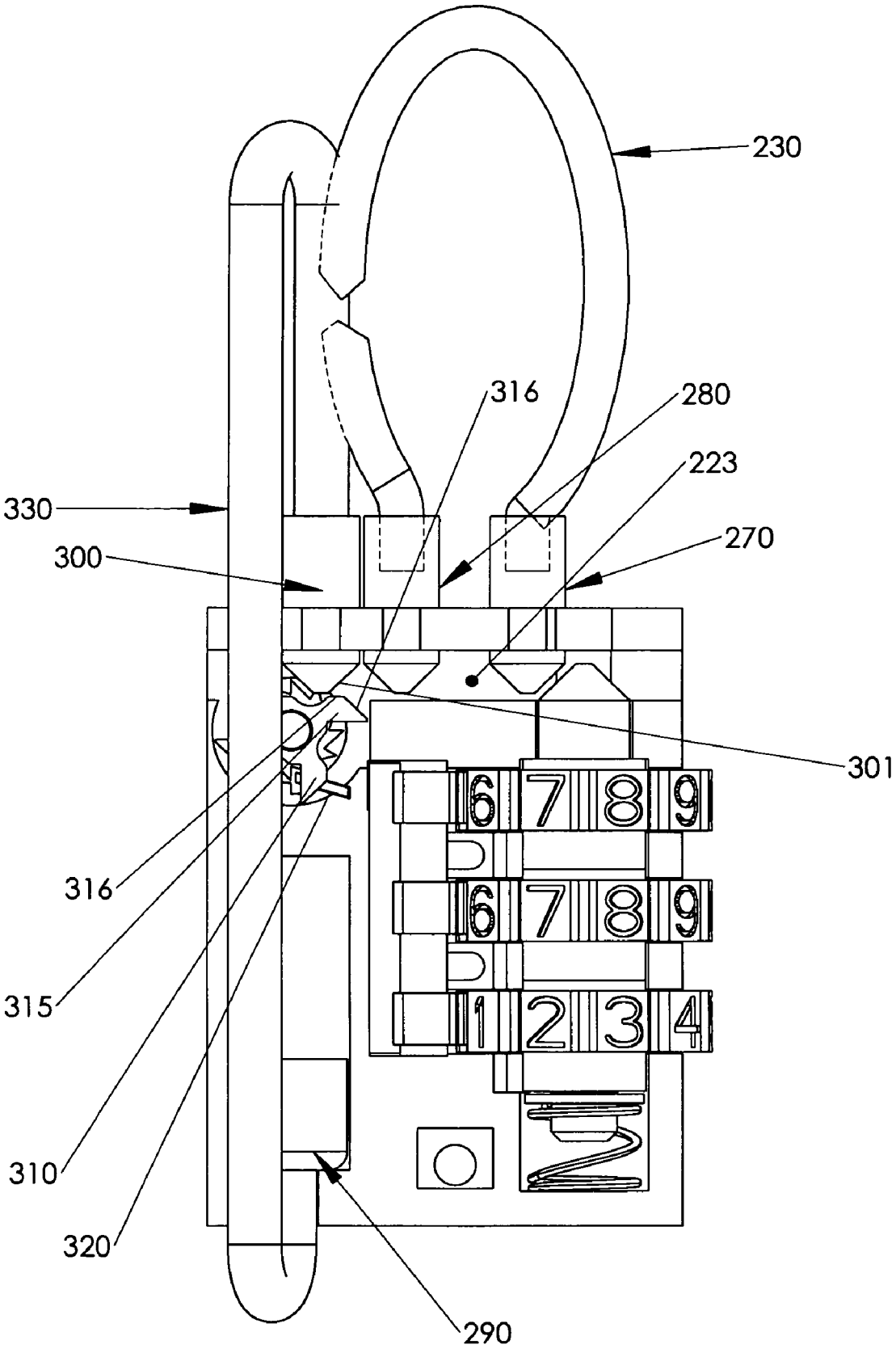
FIG. 48 is a side elevation view of the padlock of FIG. 47 shown with the secondary shackle mounted in locked engagement with the housing.
Figure 49:
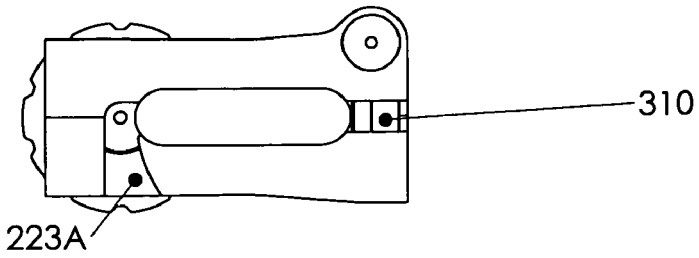
FIG. 49 is a top plan view of a still further alternate embodiment of the padlock of the present invention shown in the closed and locked position and incorporating a combination controlled locking section.
Figure 50:
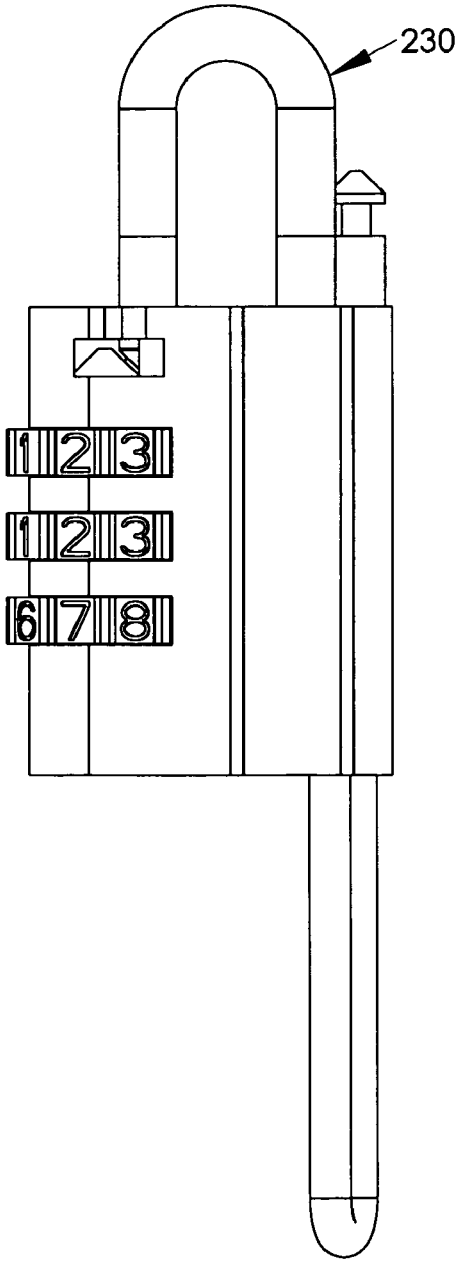
FIG. 50 is a rear side elevation view of the padlock of FIG. 49.
Figure 51:
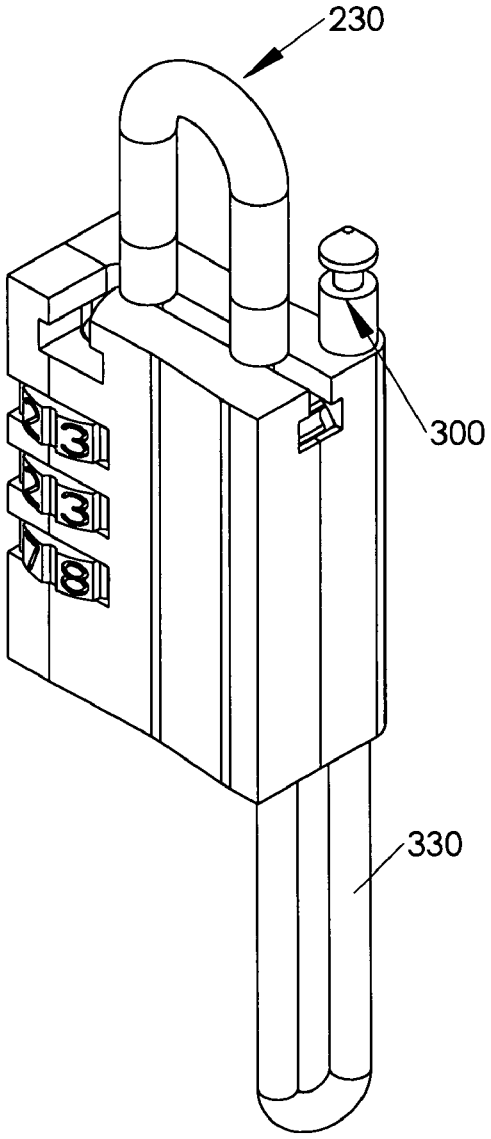
FIG. 51 is a perspective view of the padlock of FIG. 49.
Figure 52:
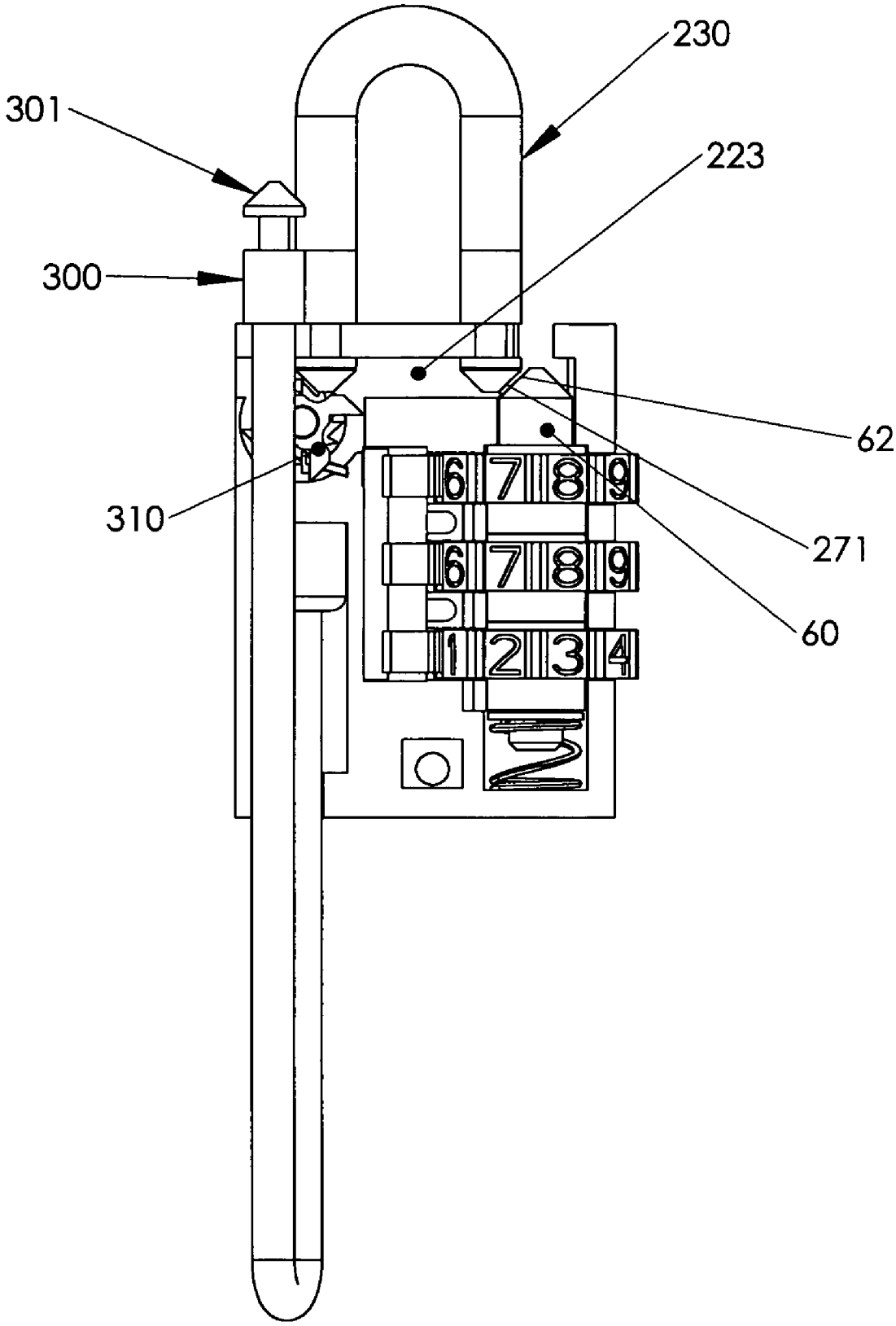
FIG. 52 is a front side elevation view of the padlock of FIG. 49 shown with the cover portion of the housing removed.
Figure 53:
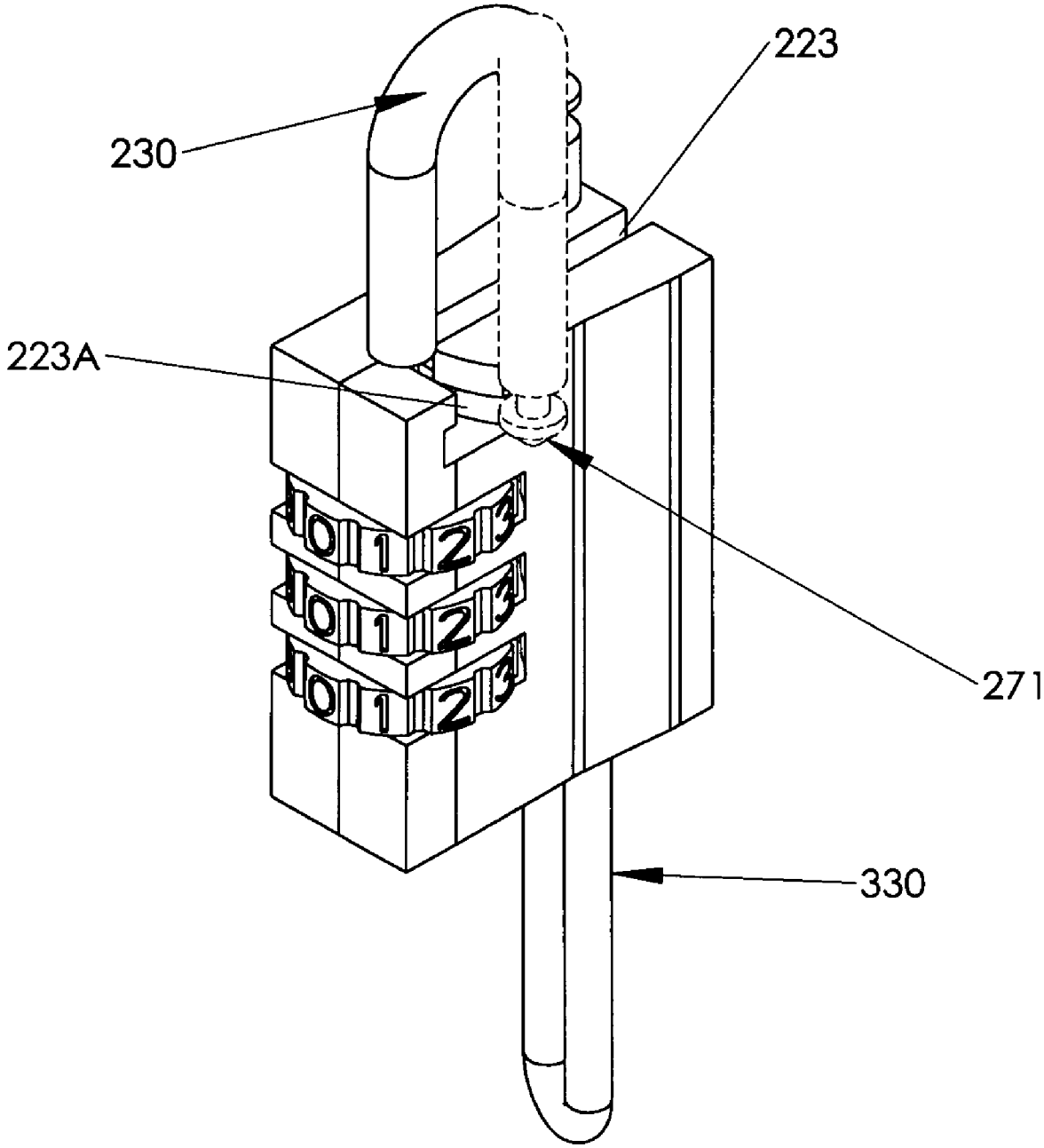
FIG. 53 is a perspective view of the padlock of FIG. 49 shown with the primary shackle disengaged from the housing.
Figure 54:
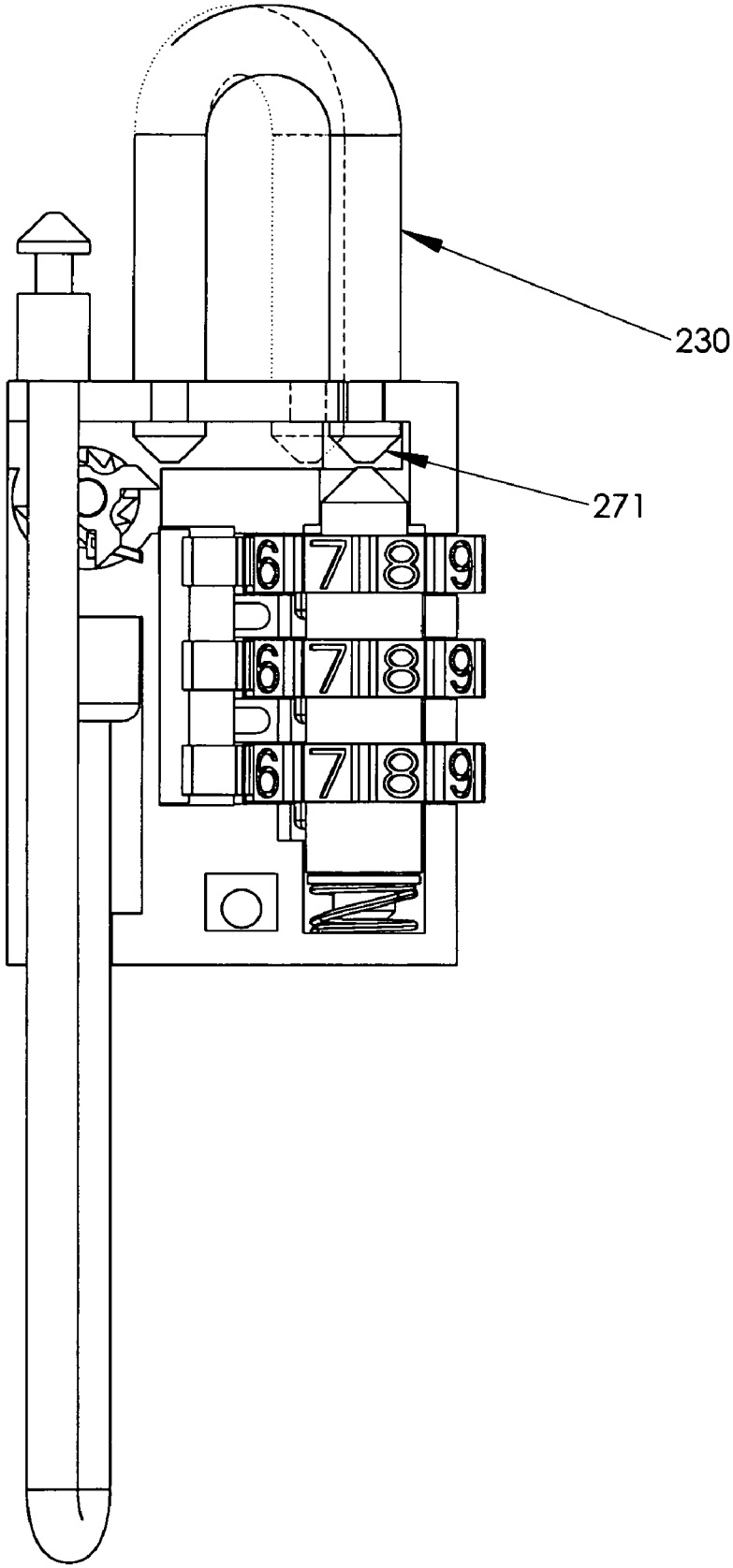
FIG. 54 is a side elevation view of the padlock of FIG. 49 shown in the open position.
Figure 55:
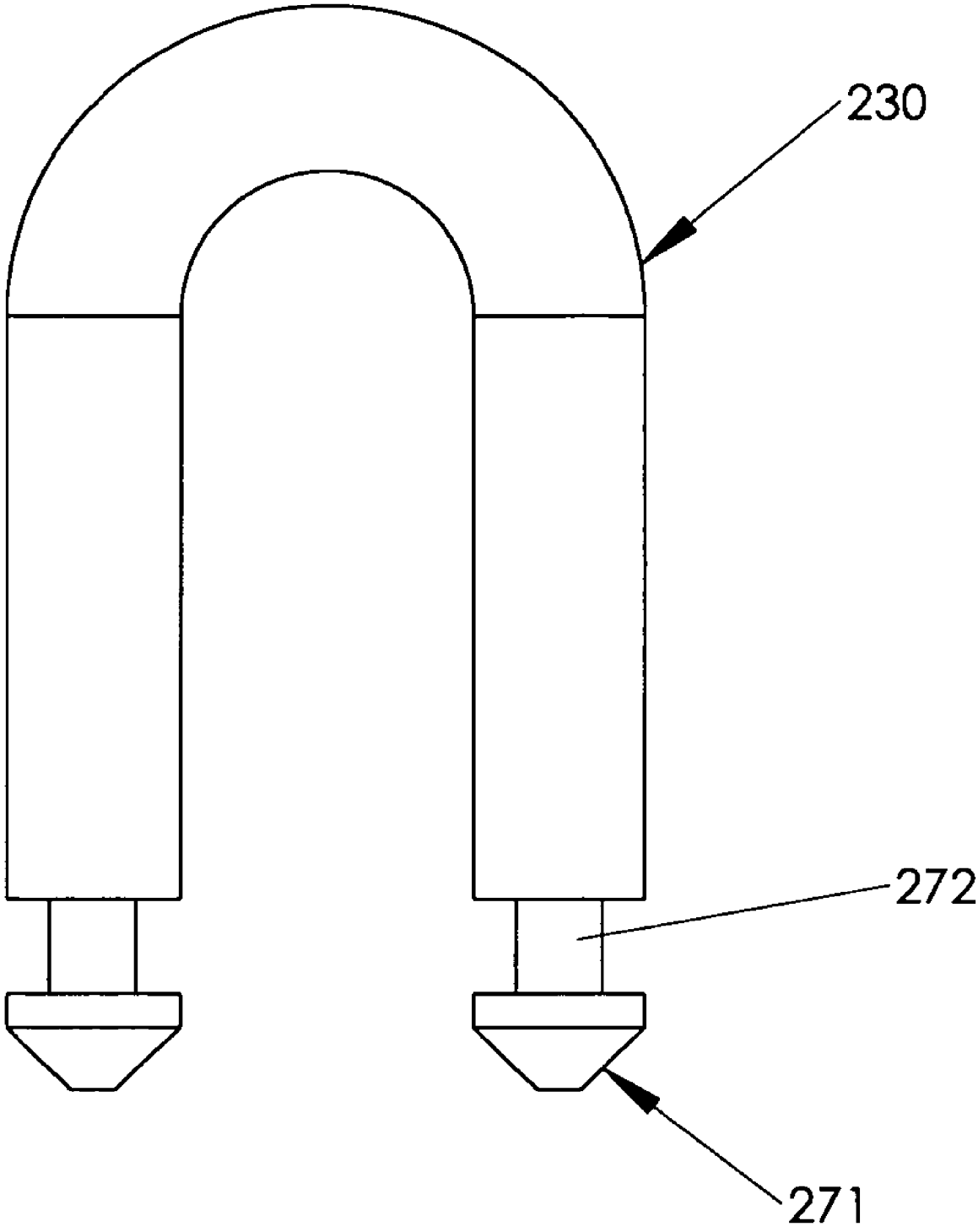
FIG. 55 is a side elevation view showing the primary shackle forming a component of the padlock of FIG. 49.

Finally, as sown in FIGS. 32 and 33, J-shaped shackle 90 and secondary shackle 120 are easily replaced by the user by employing retaining screw 130 to open housing 21 and gain access to the interior thereof. Once the replacement shackles are properly positioned, housing 21 is reassembled and ready for use.

By referring to FIGS. 34-56, along with the following detailed discussion, further alternate embodiments of the present invention can best be understood. In these further additional embodiments, a unique, and highly desirable padlock construction is achieved which provides a primary and secondary shackle, while also enabling both the primary and secondary shackles to be quickly and easily employed by both the user and security personnel. As a result, the goals and objectives of the present invention are achieved in a padlock construction which is unique, easily constructed, easily employed, and competitively produced.

In the embodiments depicted in FIGS. 34-56, padlock 20 is constructed to enable security personnel to gain access to the suitcase, package, luggage or other item to which padlock 20 has been secured by cutting primary shackle 230 and then relocking the suitcase or package by employing secondary shackle 330. As will become evident from the following detailed discussion, components incorporated into these embodiments of padlock 20 are substantially identical to components detailed above in reference to the embodiments shown in FIGS. 1-33. As a result, whenever substantially identical components performing substantially identical functions are employed, the same reference numerals have been employed in FIGS. 34-56. In this regard, any detailed discussion contained in the foregoing disclosure regarding these particular components applies equally to the components incorporated into the embodiments shown in FIGS. 34-56, with the foregoing detailed discussion regarding these components being hereby repeated and incorporated by reference. In this way, unnecessary additional disclosure is avoided.

In the embodiments of the present invention depicted in FIGS. 34-56, padlock 20 incorporates a rotatable ratchet locking member or ratchet wheel 316 which enables one terminating end of the primary shackle or secondary shackle to be maintained in locked engagement with housing 21 of padlock 20. Furthermore, as is fully detailed below, by assuring that ratchet locking member/wheel 316 is capable of being rotated in only one direction, the secure locking engagement of the terminating end of the primary shackle or secondary shackle is assured.

Furthermore, by employing this embodiment of the present invention, security personnel are able to quickly and easily relock padlock 20 after the primary cable has been cut. In addition, the present invention also provides ease of removal and replacement of the primary shackle or secondary shackle by the user when required.

In the embodiment of the present invention shown in FIGS. 34-48, padlock 20 comprises housing 21 which incorporates primary shackle 230 which is constructed for movement between locked engagement with housing 21 and being unlocked therefrom. In order to enable primary shackle 230, as well as secondary shackle 330 to be lockingly engaged with housing 21 of padlock 20, housing 21 incorporates channel or slot 223 formed therein which extends from one side edge of housing 21 to the opposed side edge.

In the preferred construction, channel/slot 223 comprises a T-shape and is formed by flanges 224 and 225 which form a part of housing 21 and are in juxtaposed, spaced, facing relationship with each other. In addition, flanges 224 and 225 define a narrow opening or passageway between the facing surfaces thereof, with an enlarged open zone or passageway being formed directly below flanges 224 and 225. In this way, a generally inverted T-shape channel/slot 223 is achieved.

In addition, primary shackle 230 incorporates sleeve member 270 mounted at one end thereof while sleeve member 280 is mounted at the opposed end thereof. In the preferred construction, sleeve member 270 incorporates base 274 which peripherally surrounds and is securely affixed to the terminating end of primary shackle 230. In addition, sleeve member 270 incorporates an enlarged head 271 having a tapered or sloping end configuration, along with small diameter rod 272 which interconnects head 271 with base 274. In the preferred construction, sleeve member 280 incorporates a virtually identical construction.

By employing sleeve members 270 and 280, rapid engagement and disengagement with channel or slot 223 is achieved. In this regard, small diameter rod 272 is dimensioned for sliding, longitudinal movement in the narrow passageway formed between flanges 224 and 225. In addition, enlarged head 271 is dimensioned for sliding, longitudinal movement in the enlarged zone or passageway formed directly below flanges 224 and 225. Furthermore, due to the enlarged diameter of head 271, head 271 is incapable of passing between flanges 224 and 225. As a result, head 271 of sleeve member 270 remains captured in channel or slot 223, capable of only longitudinal sliding movement therein.

Preferably, this embodiment of padlock 20 incorporates a combination controlled locking section for enabling sleeve member 270 to be lockingly engaged and disengaged with housing 21 of padlock 20. In this way, primary shackle 230 is able to be quickly and easily securely affixed to housing 21, as well as quickly disengaged or unlocked from housing 21.

Generally, the locking section incorporated into housing 21 of this embodiment of padlock 20 is substantially identical to the locking section detailed above in reference to the embodiment shown in FIGS. 1-17. In this regard, longitudinally extending shaft or spindle 60 is employed and is peripherally surrounded by a plurality of dials 40 which control the axial or longitudinal movement of spindle 60. Dials 40 are cooperatively associated with clutch wheels 50 which incorporate notches 51 and are constructed for enabling spindle 60 to move longitudinally when notches are properly aligned.

In addition, spindle 60 incorporates sloping or tapered upper end surface 62 which is cooperatively associated with the tapered or sloping end configuration of enlarged head 271 of sleeve member 270. In operation, spindle 60 is continuously biased upwardly due to the spring member mounted at the base thereof, with clip 280 holding clutch 50 in position on spindle 60. In addition, longitudinal movement of spindle 60 is prevented until dials 40 and clutch wheels 50 are placed in the proper, predefined position. Once this has been achieved, spindle 60 is capable of being longitudinally moved downwardly.

This downward longitudinal movement is achieved by the user, after placing dials 40 in their proper predefined positions, and advancing sleeve member 270 into contact with sloping/tapered end 62 of spindle 60. Whenever the sloping or tapered end of enlarged head 271 contacts sloping/tapered end 62 of spindle 60, the continued movement of sleeve member 270 causes spindle 60 to be moved vertically downwardly. Once the upper end of spindle 60 has cleared channel or slot 223, sleeve member 270 can be advanced outwardly from channel or slot 223, effectively releasing primary shackle 230 from locked engagement with housing 21.

As detailed herein, whenever dials 40 are placed with the desired, preset combination being properly displayed, spindle 60 is capable of axial movement relative thereto. However, whenever dials 40 are not positioned with the proper indicia displayed in the correct orientation, spindle 60 is incapable of longitudinal movement. As stated above, the overall construction and operation of dials 40 and the entire combination controlled locking section of the present invention are disclosed in the U.S. Pat. No. 6,029,481, the pertinent portions of which are incorporated herein by reference.

In this embodiment of the present invention, primary shackle 230 incorporates a construction which enables security personnel to easily cut shackle 230 whenever required for inspecting luggage, a suitcase, or other item to which padlock 20 has been secured. Once shackle 230 has been severed, padlock 20 is easily removed from the luggage, suitcase or other package in order to allow the security personnel to gain access to the suitcase/package.

Once the security officer has completed his inspection of the luggage, suitcase, package, or other item, padlock 20 of the present invention is quickly and easily relocked on the suitcase in order to protect the contents of the suitcase. In this regard, in order to enable padlock 20 to be relocked by the security officer padlock 20 incorporates secondary shackle 330.

As clearly shown in the drawings, secondary shackle 330 incorporates an elongated length of cable or flexible material with sleeve member 300 mounted to one terminating end of shackle 330, while enlarged sleeve member 290 mounted to the opposed end of secondary shackle 330. In addition, sleeve member 300 incorporates enlarged terminating head 301 and smaller diameter rod portion 302 extending from enlarged head 301 to the base of sleeve number 300.

In the preferred construction, secondary shackle 330 is partially retained within slot 292 and elongated channel 293. As depicted, slot 292 is constructed to enable enlarged sleeve member 290 to longitudinally move therein, while preventing the removal of sleeve member 290 from slot 292. In the preferred construction of channel 293, channel 293 is open at both ends, thereby allowing secondary shackle 330 longitudinally to pass through channel 293. In this way, sleeve member 300 is capable of being extended from housing 21 and moved to any desired position, limited only by the length of the cable forming secondary cable 330.

In this embodiment of the present invention, padlock 20 incorporates ratchet wheel or ring assembly 310 mounted in padlock 20 in cooperating association with channel or slot 223. As detailed herein, ratchet wheel/ring assembly 310 operates to enable sleeve member 300 of secondary cable 330 to be advanced into channel or slot 223 and lockingly retained therein. In this way, the security personnel are able to relock any suitcase, luggage, package, or other item which has been open for inspection, in order to assure that the contents thereof remains safe. Furthermore, using this embodiment of the present invention, the security officer is quickly and easily able to relock the suitcase, luggage, package, or other item by merely withdrawing secondary cable 330 from its stowed position in housing 21 and advance sleeve member 300 into channel or slot 223 until sleeve member 300 has passed ratchet wheel/ring assembly 310, thereby placing sleeve member 300 in locked engagement with housing 21.

In its preferred construction, ratchet wheel/ring assembly 310 comprises a ratchet wheel/ring member 316 which incorporates central passageway 313 formed along the central axis of ratchet wheel/ring member 316. In addition, housing 21 incorporates mounting pin or shaft 222 which is constructed for enabling ratchet wheel/ring member 316 to be mounted thereon by passing pin/shaft 222 through central passageway 313. In this way, ratchet wheel/ring member 316 is capable of rotational movement about pin/shaft 222 when mounted to housing 21.

In order to provide the desired operation, ratchet wheel/ring member 316 comprises a plurality of radially extending teeth 312, each of which comprise substantially identical constructions and cooperate to define a substantially circular array having a first diameter. In addition, ratchet wheel/ring member 316 also incorporates four radially extending arm members 314 mounted adjacent teeth 312, each of which is substantially identical in construction, is equally spaced from each other, and defines a second diameter which is greater than the first diameter established by the plurality of teeth.

In the preferred construction, radially extending arm members are spaced apart from each other defining retaining slots 315 formed therebetween, with each retaining slot 315 being constructed for enabling enlarged head 301 of sleeve member 300 to be positioned and securely retained therein. By employing this construction, enlarged head 301 of sleeve member 300 is quickly and easily positioned into channel or slot 223 and advanced through channel or slot 223 into contact with ratchet wheel/ring member 316. Furthermore, each radially extending arm member 314 of ratchet wheel/ring member 316 comprises a sloping face or surface which is constructed for cooperating with the sloping end of enlarged head 301.

As a result, whenever enlarged head 301 of sleeve member 300 is advanced into channel or slot 223, contact between enlarged head 301 and radially extending arm member 314 clauses ratchet wheel/ring member 316 to rotate about supporting pin/shaft 222, enabling sleeve member 300 to enter retaining slot 315 and advance into the portion of channel or slot 223 which extends beyond ratchet wheel/ring member 316. As a result, secondary shackle 330 is able to be quickly and easily placed in locked interengagement with housing 21 by the security personnel, thereby enabling the luggage, suitcase, package, and the like to be relocked after inspection.

In order to assure that sleeve member 300 of secondary shackle 330 is placed in locked engagement in channel/slot 223 of housing 21, ratchet wheel/ring assembly 310 incorporates a construction which enables ratchet wheel/ring member 316 to rotate in only one direction, while preventing ratchet wheel/ring member 316 from rotating in the opposite direction. In this way, assurance is provided that sleeve member 300 is able to enter channel/slot 223, advance past ratchet wheel/ring member 316, and then be secured in locked engagement therein.

In controlling the rotational movement of a ratchet wheel/ring member 316 and assuring that ratchet wheel/ring member 316 rotates in only one direction, ratchet wheel/ring assembly 310 incorporates flexible stop plate 320 which is mounted in housing 21 extending from its mounted position into cooperating engagement with teeth 312 of ratchet wheel/ring member 316. In its preferred construction, flexible stop plate 320 incorporates terminating end 321 which is positioned for contacting substantially flat surface 312*a* of teeth 312.

In addition, due to the flexibility of stop plate 320, ratchet wheel/ring member 316 is able to rotate in a clockwise direction, with each tooth 312 deflecting or flexing stop plate 320 for enabling the rotational movement thereof. However, if rotational movement of ratchet wheel/ring member 316 in the opposite, counterclockwise direction is attempted, flat surface 312*a* of tooth 312 is brought into contact with terminating end 321 of stop plate 320, preventing rotational movement of ratchet wheel/ring member 316 in that direction.

As a result ratchet wheel/remember 316 is able to rotate in only one desired direction, while rotational movement in the opposite direction is prevented. In this way, assurance is provided that secondary shackle 330, when placed within channel/slot 223, is maintained in locked engagement therein, and is removable from housing 21 only by the operation of combination control locking section.

By employing this embodiment of the present invention, the user is able to quickly and easily replace primary shackle 230 and return secondary shackle 330 to its original position. In this regard, whenever the luggage, suitcase, package, or other item is received by the user after primary shackle 230 has been cut, the user merely positions dials 40 in the preset combination, thereby enabling spindle 60 to be longitudinally movable. Once in this position, sleeve members 270 and 280 of primary shackle 230 can be quickly removed from channel or slot 223, along with sleeve member 300 of secondary shackle 330. Once released, secondary shackle 330 can be returned to its original stowed position, while a new primary shackle 230 is installed in the desired position.

Whenever desired, the user is able to reset the combination to be displayed by dials 40 in order to unlock padlock 20. In this regard, in order to reset the combination, the user merely pushes spindle 60 downwardly until fins 5lA of clutches 50 are moved out of teeth 41 of dials 40. Once in this position, the user holds spindle 60 in this position and turns dials 40 into the desired new combination. Once the combination has been set, the user merely releases spindle 60, thereby completing the resetting of the desired new combination. As shown in the drawings, clutches 50 are maintained in the desired position relative to spindle 60 due to the incorporation of a circular clip 280 mounted at the lower end of spindle 60 for maintaining clutches 50 in the desired position in cooperating relationship with dials 40.

In FIGS. 49-55, a further alternate embodiment of the present invention is depicted. In this embodiment, padlock 20 is constructed in a manner substantially identically to the embodiment detailed above in reference to FIGS. 34-48, except for one alternate configuration. In the foregoing embodiment, elongated channel/slot 223 is constructed in a substantially continuous, longitudinally extending configuration which begins at one side edge of housing 21 and extends to the opposed side edge of housing 21. In this alternate embodiment, elongated channel/slot 223 begins at one side edge of housing 21, in association with ratchet wheel/or ring assembly 310, and terminates in substantial alignment with a spindle 60, with exit/entry channel 223A being formed in cooperating relationship with spindle 60 and extending substantially perpendicularly to channel/slot 223, terminating in one wall of housing 21. In this way, any cooperating sleeve member which is to be inserted into channels/slot 223 or removed therefrom passes by spindle 60 and exits or enters channel/slot 223 through exit/entry channel 223A and the cooperating wall of housing 21.

Finally, in FIG. 56, a still further alternate embodiment of padlock 20 of the present invention is depicted. In this embodiment, padlock 20 is constructed in a manner substantially identical to the constructions detailed above in reference to FIGS. 34-55. However, in this embodiment, a further unique construction is provided by incorporating additional locking hole or aperture 350 which can be employed for enabling different locking means such as shackles, cables, bolts, chains, and the like, providing additional locking elements. In this way, a multi-element locking structure is realized.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

The invention claimed is:

1. A padlock constructed for securing luggage, suitcases, and the like comprising:

A. a housing incorporating an elongated, longitudinally extending slot or channel comprising a T-shape in cross-section;

B. a first shackle a) mounted to the housing for movement between a first housing engaged and locked position and a second housing disengaged unlocked position;

b) constructed for enabling the shackle to be cut by security personnel; and c) comprising an elongated body terminating at one end with an enlarged head connected to a reduced diameter rod member extending from the shackle body and dimensioned for cooperative, sliding engagement in said T-shaped slot/channel;

C. a combination controlled locking assembly mounted in the housing and constructed for controllably locking and unlocking the shackle with the housing, said locking assembly incorporating an axially movable spindle cooperatively associated with the slot/channel for movement between a first slot blocking position and a slot open position at a first end of the slot/channel;

D. a secondary shackle a) mounted to the housing and movable from a first stowed position to a second locking assembly engaged position, b) comprising an elongated body terminating at a first end fixedly mounted to the housing and at a second end which is movable relative to the housing and comprises an enlarged head connected to a smaller diameter rod extending from the shackle body, said second end being constructed for cooperating, sliding engagement in the slot/channel of the housing; and E. a ratchet/wheel ring assembly mounted in the housing in cooperating association with a second end of the slot/channel and constructed for enabling the second end of the secondary shackle to be inserted into the slot/channel when the locking assembly is in the locked mode.

2. The padlock defined in claim 1, wherein the ratchet wheel/ring assembly is further defined as comprising a ratchet wheel/ring member mounted in the housing for rotational movement and comprises a circular shaped support base incorporating:

a) a plurality of teeth formed therein and defining a substantially circular shaped array having a first diameter, b) a plurality of radially extending arms formed adjacent the plurality of teeth and defining a circular shaped array having a second diameter larger than the first diameter, and c) a support passageway extending through said base along the central axis thereof and constructed for enabling said support base to be mounted on a pin or rod formed in said housing for enabling said support base to be rotational relative thereto.

3. The padlock defined in claim 2, wherein the ratchet wheel/ring member is further defined as comprising four radially extending arm members each of which are equally spaced from each other and define a retaining zone therebetween dimensioned for receiving the second end of the secondary shackle for enabling the second end of the secondary shackle to enter the slot/channel and be retained therein when the locking assembly is in the locked position.

4. The padlock defined in claim 3, wherein the ratchet wheel/ring member is further defined as being cooperatively associated with a stop plate mounted in the housing and positioned for engaging the plurality of teeth formed thereon, enabling the ratchet wheel/ring member to rotate in one direction, while preventing rotation of the ratchet wheel/ring member in the opposite direction, thereby assuring the ability of the second end of the secondary shackle to enter the slot/channel while being incapable of being removed therefrom by passage through the ratchet wheel/ring member.

5. The padlock defined in claim 1, wherein said elongated slot/channel is further defined as extending from one side edge of the housing to the opposed side edge thereof.

* * * * *